US008780104B2

(12) United States Patent
Chuei et al.

(10) Patent No.: US 8,780,104 B2
(45) Date of Patent: Jul. 15, 2014

(54) SYSTEM AND METHOD OF UPDATING DRIVE SCHEME VOLTAGES

(75) Inventors: Nao S. Chuei, San Mateo, CA (US); Koorosh Aflatooni, Cupertino, CA (US); Wilhelmus Johannes Robertus Van Lier, San Diego, CA (US); Pramod K. Varma, La Jolla, CA (US); Ramesh K. Goel, San Diego, CA (US); Sameer Venugopal, San Jose, CA (US)

(73) Assignee: Qualcomm MEMS Technologies, Inc., San Diego, CA (US)

( * ) Notice: Subject to any disclaimer, the term of this patent is extended or adjusted under 35 U.S.C. 154(b) by 255 days.

(21) Appl. No.: 13/279,187

(22) Filed: Oct. 21, 2011

(65) Prior Publication Data

US 2012/0235985 A1 Sep. 20, 2012

Related U.S. Application Data

(60) Provisional application No. 61/453,083, filed on Mar. 15, 2011.

(51) Int. Cl.
*G09G 5/00* (2006.01)

(52) U.S. Cl.
USPC ..... 345/214; 345/204; 345/211; 359/291

(58) Field of Classification Search
USPC ..... 345/204, 209, 211, 214; 359/291
See application file for complete search history.

(56) References Cited

U.S. PATENT DOCUMENTS

| | | | |
|---|---|---|---|
| 4,954,789 | A | 9/1990 | Sampsell |
| 5,784,189 | A | 7/1998 | Bozler et al. |
| 5,994,841 | A | 11/1999 | Allen et al. |
| 6,040,937 | A | 3/2000 | Miles |
| 6,329,971 | B2 | 12/2001 | McKnight |
| 6,574,033 | B1 | 6/2003 | Chui et al. |
| 6,674,562 | B1 | 1/2004 | Miles |
| 6,804,141 | B1 | 10/2004 | Rickes et al. |
| 6,813,062 | B2 | 11/2004 | Sandstrom |
| 6,900,782 | B2 | 5/2005 | Tokunaga et al. |
| 7,042,643 | B2 | 5/2006 | Miles |
| 7,123,216 | B1 | 10/2006 | Miles |
| 7,327,510 | B2 | 2/2008 | Cummings et al. |
| 7,355,779 | B2 | 4/2008 | Mignard et al. |
| 7,411,430 | B2 | 8/2008 | Cheng et al. |
| 7,551,159 | B2 | 6/2009 | Mignard et al. |

(Continued)

FOREIGN PATENT DOCUMENTS

| | | |
|---|---|---|
| EP | 1517287 A2 | 3/2005 |
| EP | 1 630 781 | 3/2006 |

(Continued)

OTHER PUBLICATIONS

ISR and WO dated Jul. 2, 2012 in PCT/US12/027559.

(Continued)

*Primary Examiner* — Premal Patel

(74) *Attorney, Agent, or Firm* — Knobbe Martens Olson & Bear LLP

(57) ABSTRACT

This disclosure provides systems, methods and apparatus, including computer programs encoded on computer storage media, for calibrating display arrays. In one aspect, a method of calibrating a display array includes determining a particular drive response characteristic and updating a particular drive scheme voltage between updates of image data on the display array.

42 Claims, 17 Drawing Sheets

(56) References Cited

U.S. PATENT DOCUMENTS

| | | | | |
|---|---|---|---|---|
| 7,560,299 | B2 | 7/2009 | Cummings | |
| 7,643,202 | B2 | 1/2010 | Sasagawa | |
| 7,715,085 | B2 | 5/2010 | Sasagawa | |
| 7,889,163 | B2 | 2/2011 | Chui et al. | |
| 7,924,041 | B2 | 4/2011 | No et al. | |
| 7,990,604 | B2 | 8/2011 | Lee et al. | |
| 2003/0030446 | A1 | 2/2003 | Wang et al. | |
| 2003/0122813 | A1 | 7/2003 | Ishizuki et al. | |
| 2006/0067652 | A1 | 3/2006 | Cummings et al. | |
| 2006/0067653 | A1 | 3/2006 | Gally et al. | |
| 2006/0279290 | A1 | 12/2006 | Swenson et al. | |
| 2007/0046950 | A1 | 3/2007 | Brown et al. | |
| 2008/0059099 | A1 | 3/2008 | Kim et al. | |
| 2008/0106784 | A1 | 5/2008 | Chui et al. | |
| 2008/0122822 | A1 | 5/2008 | Pan et al. | |
| 2008/0144174 | A1 | 6/2008 | Lucente et al. | |
| 2008/0170004 | A1 | 7/2008 | Jung | |
| 2009/0086306 | A1 | 4/2009 | Kothari et al. | |
| 2009/0135465 | A1 | 5/2009 | Chui | |
| 2009/0201282 | A1 | 8/2009 | Govil | |
| 2009/0204349 | A1* | 8/2009 | Govil et al. | 702/64 |
| 2009/0207159 | A1 | 8/2009 | Govil | |
| 2010/0039409 | A1* | 2/2010 | Govil | 345/204 |
| 2010/0238572 | A1 | 9/2010 | Tao et al. | |
| 2010/0245313 | A1 | 9/2010 | Lewis et al. | |
| 2012/0056867 | A1 | 3/2012 | Van Lier et al. | |
| 2012/0062615 | A1 | 3/2012 | Van Lier et al. | |
| 2012/0235985 | A1 | 9/2012 | Chuei et al. | |
| 2012/0274666 | A1 | 11/2012 | Aflatooni et al. | |

FOREIGN PATENT DOCUMENTS

| | | | |
|---|---|---|---|
| WO | WO 2006/121608 | | 11/2006 |
| WO | 2007120849 | A2 | 10/2007 |
| WO | WO 2010/147786 | | 12/2010 |

OTHER PUBLICATIONS

Qualcomm, 2007, Operating principles of mirasol™ displays: interferometric modulation (IMOD) drive, 16 pp.

Lee, et al., "Suppression of TFT Leakage Current Effect on Active Matrix Displays by Employing a New Circular Switch," Solid-State Electronics,2007, 52(3), 467-472.

* cited by examiner

Common Voltages

| Segment Voltages | $VC_{ADD_H}$ | $VC_{HOLD_H}$ | $VC_{REL}$ | $VC_{HOLD_L}$ | $VC_{ADD_L}$ |
|---|---|---|---|---|---|
| $VS_H$ | Stable | Stable | Relax | Stable | Actuate |
| $VS_L$ | Actuate | Stable | Relax | Stable | Stable |

SYSTEM AND METHOD OF UPDATING DRIVE SCHEME VOLTAGES

CROSS-REFERENCE TO RELATED APPLICATIONS

This disclosure claims priority under 35 U.S.C. §119(e) to U.S. Provisional Patent Application No. 61/453,083, filed Mar. 15, 2011, which is hereby incorporated by reference in its entirety.

TECHNICAL FIELD

This disclosure relates to the dynamic selection of drive scheme voltages.

DESCRIPTION OF THE RELATED TECHNOLOGY

Electromechanical systems include devices having electrical and mechanical elements, actuators, transducers, sensors, optical components (e.g., mirrors) and electronics. Electromechanical systems can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of substrates and/or deposited material layers, or that add layers to form electrical and electromechanical devices.

One type of electromechanical systems device is called an interferometric modulator (IMOD). As used herein, the term interferometric modulator or interferometric light modulator refers to a device that selectively absorbs and/or reflects light using the principles of optical interference. In some implementations, an interferometric modulator may include a pair of conductive plates, one or both of which may be transparent and/or reflective, wholly or in part, and capable of relative motion upon application of an appropriate electrical signal. In an implementation, one plate may include a stationary layer deposited on a substrate and the other plate may include a reflective membrane separated from the stationary layer by an air gap. The position of one plate in relation to another can change the optical interference of light incident on the interferometric modulator. Interferometric modulator devices have a wide range of applications, and are anticipated to be used in improving existing products and creating new products, especially those with display capabilities.

SUMMARY

The systems, methods and devices of the disclosure each have several innovative aspects, no single one of which is solely responsible for the desirable attributes disclosed herein.

One innovative aspect of the subject matter described in this disclosure can be implemented in a method of calibrating drive scheme voltages in an array including a plurality of display elements. The method may include determining, for a first subset of the display elements of the array, a first voltage characterizing a voltage which causes essentially all the display elements in the first subset to actuate from a released state. The method may also include determining, for a second subset of the display elements of the array, a second voltage characterizing a voltage which causes a first display element in the second subset to actuate from a released state but which does not cause a significant number of other display elements in the second subset to actuate from a released state. The method may also include determining, for a third subset of the display elements of the array, a third voltage characterizing a voltage which causes a first display element in the third subset to release from an actuated state but which does not cause a significant number of other display elements in the third subset to release from an actuated state. Furthermore, the method may include using the first, second, and third voltages to perform maintenance calibrations during use of the array over at least some portion of the life of the array. In some aspects, at least one drive scheme voltage may be determined based at least in part on the first voltage, second voltage, and third voltage. In some aspects, using the first, second, and third voltages to perform maintenance calibrations includes repeatedly determining first, second, and third voltages, and updating drive scheme voltages based on the determined first, second, and third voltages at periodic intervals over the lifetime of the display.

In another aspect, a method of calibrating drive scheme voltages in an array including a plurality of display elements may include determining one or more drive response characteristics of one or more previously characterized subsets of display elements of the array, deriving drive scheme voltages using the determined drive response characteristics determined for the one or more previously characterized subsets of display elements, and determining one or more drive response characteristics of an additional different subset of display elements of the array to characterize the additional different subset of display elements of the array. In some aspects, the additional different subset of display elements of the array may be substituted for one of the one or more previously characterized subsets of display elements of the array.

Other innovative aspects may be implemented in an apparatus for calibrating drive scheme voltages. The apparatus may include an array of display elements, display element state sensing circuitry, and driver and processor circuitry. The driver and processor circuitry may be configured to determine, for a first subset of the display elements of the array, a first voltage characterizing a voltage which causes essentially all the display elements in the first subset to actuate from a released state, determine, for a second subset of the display elements of the array, a second voltage characterizing a voltage which causes a first display element in the second subset to actuate from a released state but which does not cause a significant number of other display elements in the second subset to actuate from a released state, and determine, for a third subset of the display elements of the array, a third voltage characterizing a voltage which causes a first display element in the third subset to release from an actuated state but which does not cause a significant number of other display elements in the third subset to release from an actuated state. The driver and processor circuitry may be further configured to use the first, second, and third voltages to perform maintenance calibrations during use of the array.

Another innovative aspect may be implemented in an apparatus for calibrating drive scheme voltages. In this aspect, the apparatus may include an array of display elements, display element state sensing circuitry, and driver and processor circuitry configured to determine one or more drive response characteristics of one or more previously characterized subsets of display elements of the array; derive drive scheme voltages using the determined drive response characteristics determined for the one or more previously characterized subsets of display elements, and determine one or more drive response characteristics of an additional different subset of display elements of the array to characterize the additional different subset of display elements of the array.

In another innovative aspect, an apparatus for calibrating drive scheme voltages includes an array of display elements, means for determining, for a first subset of the display elements of the array, a first voltage characterizing a voltage which causes essentially all the display elements in the first subset to actuate from a released state, means for determining, for a second subset of the display elements of the array, a second voltage characterizing a voltage which causes a first display element in the second subset to actuate from a released state but which does not cause a significant number of other display elements in the second subset to actuate from a released state, means for determining, for a third subset of the display elements of the array, a third voltage characterizing a voltage which causes a first display element in the third subset to release from an actuated state but which does not cause a significant number of other display elements in the third subset to release from an actuated state, and means for using the first, second, and third voltages to perform maintenance calibrations during use of the array. In some aspects, the means for determining the first, second, and third voltages includes an integrator.

In another innovative aspect, an apparatus for calibrating drive scheme voltages includes an array of display elements, means for determining one or more drive response characteristics of one or more previously characterized subsets of display elements of the array, means for deriving drive scheme voltages using the determined drive response characteristics determined for the one or more previously characterized subsets of display elements, and means for determining one or more drive response characteristics of an additional different subset of display elements of the array to characterize the additional different subset of display elements of the array. In some aspects, the apparatus may further include means for substituting the additional different subset of display elements of the array for one of the one or more previously characterized subsets of display elements of the array.

In another innovative aspect, a non-transient tangible computer readable media has stored thereon instructions causing a driver circuit to perform the method of determining, for a first subset of the display elements of the array, a first voltage characterizing a voltage which causes essentially all the display elements in the first subset to actuate from a released state, determining, for a second subset of the display elements of the array, a second voltage characterizing a voltage which causes a first display element in the second subset to actuate from a released state but which does not cause a significant number of other display elements in the second subset to actuate from a released state, determining, for a third subset of the display elements of the array, a third voltage characterizing a voltage which causes a first display element in the third subset to release from an actuated state but which does not cause a significant number of other display elements in the third subset to release from an actuated state, and using the first, second, and third voltages to perform maintenance calibrations during use of the array.

In another innovative aspect, a non-transient tangible computer readable media has stored thereon instructions causing a driver circuit to perform the method of determining one or more drive response characteristics of one or more previously characterized subsets of display elements of the array, deriving drive scheme voltages using the determined drive response characteristics determined for the one or more previously characterized subsets of display elements, and determining one or more drive response characteristics of an additional different subset of display elements of the array to characterize the additional different subset of display elements of the array.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1:
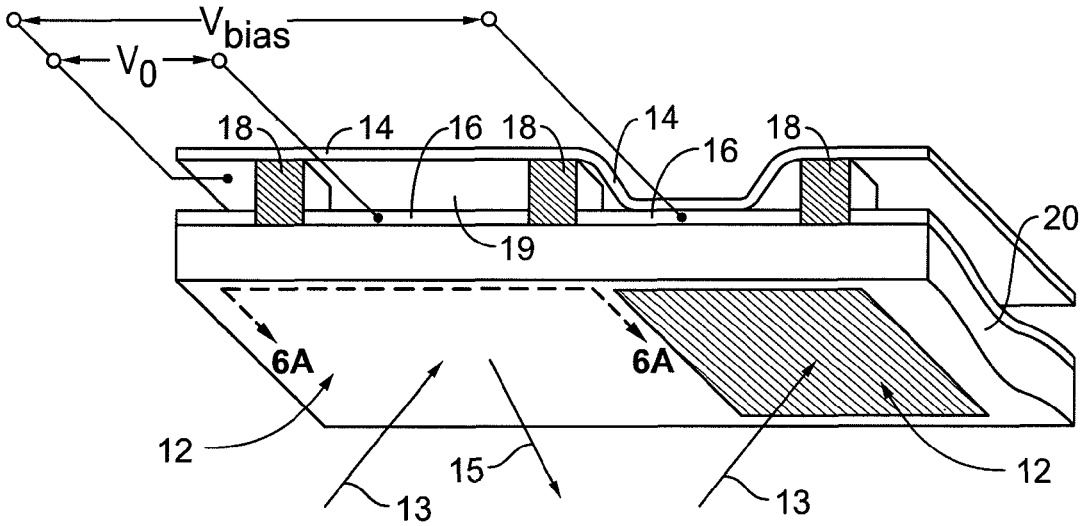
FIG. 1 shows an example of an isometric view depicting two adjacent display elements in a series of display elements of an interferometric modulator (IMOD) display device.

The following detailed description is directed to certain implementations for the purposes of describing the innovative aspects. However, the teachings herein can be applied in a multitude of different ways. The described implementations may be implemented in any device that is configured to display an image, whether in motion (e.g., video) or stationary (e.g., still image), and whether textual, graphical or pictorial. More particularly, it is contemplated that the implementations may be implemented in or associated with a variety of electronic devices such as, but not limited to, mobile telephones, multimedia Internet enabled cellular telephones, mobile television receivers, wireless devices, smartphones, bluetooth devices, personal data assistants (PDAs), wireless electronic mail receivers, hand-held or portable computers, netbooks, notebooks, smartbooks, tablets, printers, copiers, scanners, facsimile devices, GPS receivers/navigators, cameras, MP3 players, camcorders, game consoles, wrist watches, clocks, calculators, television monitors, flat panel displays, electronic reading devices (e.g., e-readers), computer monitors, auto displays (e.g., odometer display, etc.), cockpit controls and/or displays, camera view displays (e.g., display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (e.g., EMS, MEMS and non-MEMS), aesthetic structures (e.g., display of images on a piece of jewelry) and a variety of electromechanical systems devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes, and electronic test equipment. Thus, the teachings are not intended to be limited to the implementations depicted solely in the Figures, but instead have wide applicability as will be readily apparent to a person having ordinary skill in the art.

In some drive scheme implementations, the process of writing information to a display element is accomplished by applying drive scheme voltages across the display element that are sufficient to actuate the display element, release the display element, or hold the display element in its current state. Because the voltages which actuate and release the display elements may be different for different display elements, determination of appropriate drive scheme voltages to avoid artifacts in displaying an image can be difficult.

The task of determining appropriate drive scheme voltages can be further complicated by the fact that the voltages which actuate and release the display elements can change through the life of the display, e.g., with wear or with a change in temperature. Accurately measuring these values by examining the entire array to update the drive scheme voltages may be time-consuming. Thus, in some implementations, drive scheme voltages are dynamically updated based on measurements of sub-sets of the entire array. For example, in some implementations, updated drive scheme voltages are determined based on measurements of a representative line or set of lines. The lines that are chosen may represent lines exhibiting extreme values for actuation and release voltages. These extreme values are useful for deriving drive scheme voltages that work with all or substantially all of the display elements of an array. New drive scheme voltages can be derived periodically to compensate for changes over time and with temperature. In some implementations, new lines are tested to determine if the existing set of representative lines should be changed to include a new line that now has extreme actuation or release voltage.

Particular implementations of the subject matter described in this disclosure can be implemented to realize one or more of the following potential advantages. Implementations described herein allow for the changing display element actuation and release voltages to be dynamically compensated for, thereby reducing the number of artifacts in displaying an image or series of images, e.g., actuation when actuation is not desired or non-actuation when actuation is desired. Further, by updating the drive scheme voltages based on measurements of subsets of the entire array, the process can be performed quickly and frequently, thus producing a visually accurate display over the life of the display and in varying environmental conditions.

An example of a suitable EMS or MEMS device, to which the described implementations may apply, is a reflective display device. Reflective display devices can incorporate interferometric modulators (IMODs) to selectively absorb and/or reflect light incident thereon using principles of optical interference. IMODs can include an absorber, a reflector that is movable with respect to the absorber, and an optical resonant cavity defined between the absorber and the reflector. The reflector can be moved to two or more different positions, which can change the size of the optical resonant cavity and thereby affect the reflectance of the interferometric modulator. The reflectance spectrums of IMODs can create fairly broad spectral bands which can be shifted across the visible wavelengths to generate different colors. The position of the spectral band can be adjusted by changing the thickness of the optical resonant cavity, i.e., by changing the position of the reflector.

FIG. 1 shows an example of an isometric view depicting two adjacent display elements in a series of display elements of an interferometric modulator (IMOD) display device. The IMOD display device includes one or more interferometric MEMS display elements. In these devices, the display elements of the MEMS display elements can be in either a bright or dark state. In the bright ("relaxed," "open" or "on") state, the display element reflects a large portion of incident visible light, e.g., to a user. Conversely, in the dark ("actuated," "closed" or "off") state, the display element reflects little incident visible light. In some implementations, the light reflectance properties of the on and off states may be reversed. MEMS display elements can be configured to reflect predominantly at particular wavelengths allowing for a color display in addition to black and white.

The IMOD display device can include a row/column array of IMODs. Each IMOD can include a pair of reflective layers, i.e., a movable reflective layer and a fixed partially reflective layer, positioned at a variable and controllable distance from each other to form an air gap (also referred to as an optical gap or cavity). The movable reflective layer may be moved between at least two positions. In a first position, i.e., a relaxed position, the movable reflective layer can be positioned at a relatively large distance from the fixed partially reflective layer. In a second position, i.e., an actuated position, the movable reflective layer can be positioned more closely to the partially reflective layer. Incident light that reflects from the two layers can interfere constructively or destructively depending on the position of the movable reflective layer, producing either an overall reflective or non-reflective state for each display element. In some implementations, the IMOD may be in a reflective state when unactuated, reflecting light within the visible spectrum, and may be in a dark state when unactuated, reflecting light outside of the visible range (e.g., infrared light). In some other implementations, however, an IMOD may be in a dark state when unactuated, and in a reflective state when actuated. In some implementations, the introduction of an applied voltage can drive the display elements to change states. In some other implementations, an applied charge can drive the display elements to change states.

The depicted portion of the display element array in FIG. 1 includes two adjacent interferometric modulators 12. In the IMOD 12 on the left (as illustrated), a movable reflective layer 14 is illustrated in a relaxed position at a predetermined distance from an optical stack 16, which includes a partially reflective layer. The voltage $V_0$ applied across the IMOD 12 on the left is insufficient to cause actuation of the movable reflective layer 14. In the IMOD 12 on the right, the movable reflective layer 14 is illustrated in an actuated position near or adjacent the optical stack 16. The voltage $V_{bias}$ applied across the IMOD 12 on the right is sufficient to maintain the movable reflective layer 14 in the actuated position.

In FIG. 1, the reflective properties of display elements 12 are generally illustrated with arrows 13 indicating light incident upon the display elements 12, and light 15 reflecting from the display element 12 on the left. Although not illustrated in detail, it will be understood by a person having ordinary skill in the art that most of the light 13 incident upon the display elements 12 will be transmitted through the transparent substrate 20, toward the optical stack 16. A portion of the light incident upon the optical stack 16 will be transmitted through the partially reflective layer of the optical stack 16, and a portion will be reflected back through the transparent substrate 20. The portion of light 13 that is transmitted through the optical stack 16 will be reflected at the movable reflective layer 14, back toward (and through) the transparent substrate 20. Interference (constructive or destructive) between the light reflected from the partially reflective layer of the optical stack 16 and the light reflected from the movable reflective layer 14 will determine the wavelength(s) of light 15 reflected from the display element 12.

The optical stack 16 can include a single layer or several layers. The layer(s) can include one or more of an electrode layer, a partially reflective and partially transmissive layer and a transparent dielectric layer. In some implementations, the optical stack 16 is electrically conductive, partially transparent and partially reflective, and may be fabricated, for example, by depositing one or more of the above layers onto a transparent substrate 20. The electrode layer can be formed from a variety of materials, such as various metals, for example indium tin oxide (ITO). The partially reflective layer can be formed from a variety of materials that are partially reflective, such as various metals, e.g., chromium (Cr), semiconductors, and dielectrics. The partially reflective layer can be formed of one or more layers of materials, and each of the layers can be formed of a single material or a combination of materials. In some implementations, the optical stack 16 can include a single semi-transparent thickness of metal or semiconductor which serves as both an optical absorber and conductor, while different, more conductive layers or portions (e.g., of the optical stack 16 or of other structures of the IMOD) can serve to bus signals between IMOD display elements. The optical stack 16 also can include one or more insulating or dielectric layers covering one or more conductive layers or a conductive/absorptive layer.

In some implementations, the layer(s) of the optical stack 16 can be patterned into parallel strips, and may form row electrodes in a display device as described further below. As will be understood by one having skill in the art, the term "patterned" is used herein to refer to masking as well as etching processes. In some implementations, a highly conductive and reflective material, such as aluminum (Al), may be used for the movable reflective layer 14, and these strips may form column electrodes in a display device. The movable reflective layer 14 may be formed as a series of parallel strips of a deposited metal layer or layers (orthogonal to the row electrodes of the optical stack 16) to form columns deposited on top of posts 18 and an intervening sacrificial material deposited between the posts 18. When the sacrificial material is etched away, a defined gap 19, or optical cavity, can be formed between the movable reflective layer 14 and the optical stack 16. In some implementations, the spacing between posts 18 may be approximately 1-1000 um, while the gap 19 may be less than 10,000 Angstroms (Å).

In some implementations, each display element of the IMOD, whether in the actuated or relaxed state, is essentially a capacitor formed by the fixed and moving reflective layers. When no voltage is applied, the movable reflective layer 14 remains in a mechanically relaxed state, as illustrated by the display element 12 on the left in FIG. 1, with the gap 19 between the movable reflective layer 14 and optical stack 16. However, when a potential difference, e.g., voltage, is applied to at least one of a selected row and column, the capacitor formed at the intersection of the row and column electrodes at the corresponding display element becomes charged, and electrostatic forces pull the electrodes together. If the applied voltage exceeds a threshold, the movable reflective layer 14 can deform and move near or against the optical stack 16. A dielectric layer (not shown) within the optical stack 16 may prevent shorting and control the separation distance between the layers 14 and 16, as illustrated by the actuated display element 12 on the right in FIG. 1. The behavior is the same regardless of the polarity of the applied potential difference. Though a series of display elements in an array may be referred to in some instances as "rows" or "columns," a person having ordinary skill in the art will readily understand that referring to one direction as a "row" and another as a "column" is arbitrary. Restated, in some orientations, the rows can be considered columns, and the columns considered to be rows. Furthermore, the display elements may be evenly arranged in orthogonal rows and columns (an "array"), or arranged in non-linear configurations, for example, having certain positional offsets with respect to one another (a "mosaic"). The terms "array" and "mosaic" may refer to either configuration. Thus, although the display is referred to as including an "array" or "mosaic," the elements themselves need not be arranged orthogonally to one another, or disposed in an even distribution, in any instance, but may include arrangements having asymmetric shapes and unevenly distributed elements.

Figure 2:
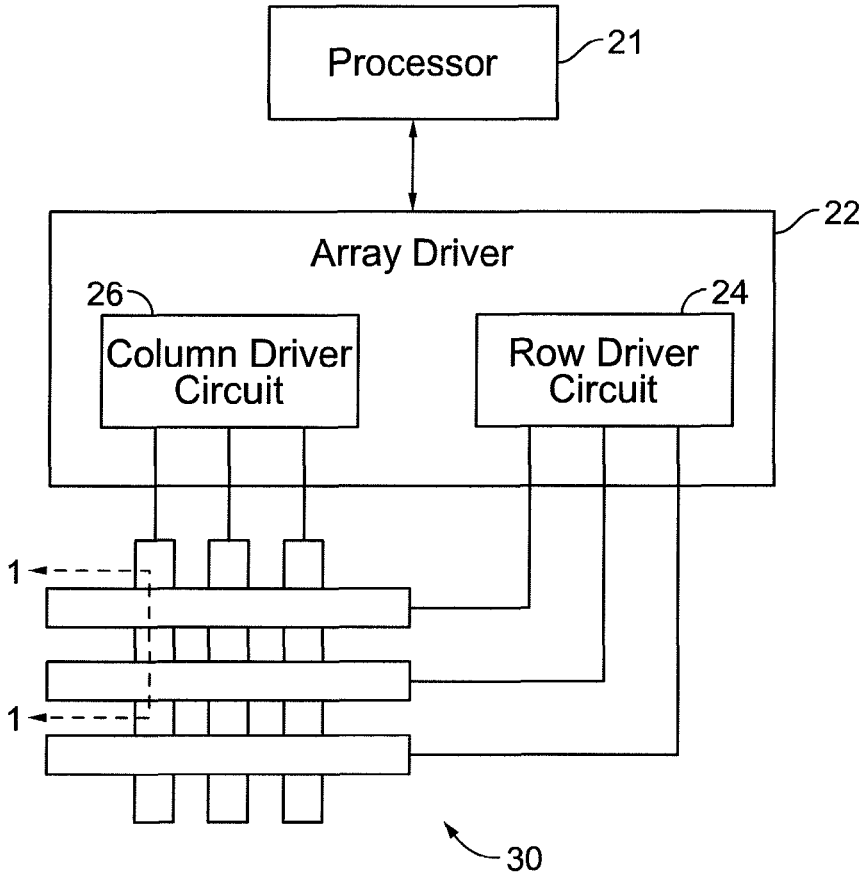
FIG. 2 shows an example of a system block diagram illustrating an electronic device incorporating a 3×3 interferometric modulator display.

FIG. 2 shows an example of a system block diagram illustrating an electronic device incorporating a 3×3 interferometric modulator display. The electronic device includes a processor 21 that may be configured to execute one or more software modules. In addition to executing an operating system, the processor 21 may be configured to execute one or more software applications, including a web browser, a telephone application, an email program, or any other software application.

The processor 21 can be configured to communicate with an array driver 22. The array driver 22 can include a row driver circuit 24 and a column driver circuit 26 that provide signals to, e.g., a display array or panel 30. The cross section of the IMOD display device illustrated in FIG. 1 is shown by the lines 1-1 in FIG. 2. Although FIG. 2 illustrates a 3×3 array of IMODs for the sake of clarity, the display array 30 may contain a very large number of IMODs, and may have a different number of IMODs in rows than in columns, and vice versa.

Figures 3, 4:
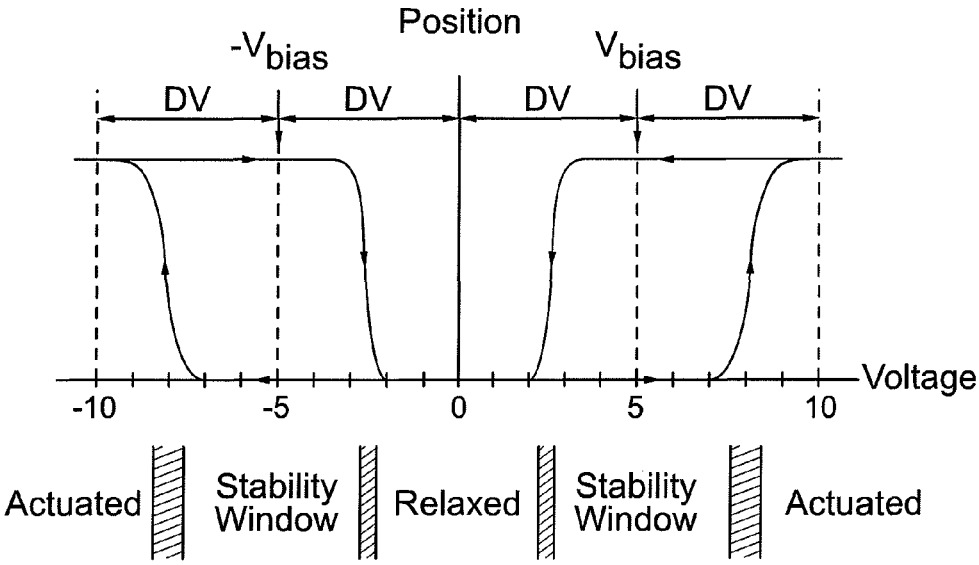
FIG. 3 shows an example of a diagram illustrating movable reflective layer position versus applied voltage for the interferometric modulator of FIG. 1.
FIG. 4 shows an example of a table illustrating various states of an interferometric modulator when various common and segment voltages are applied.

FIG. 3 shows an example of a diagram illustrating movable reflective layer position versus applied voltage for the interferometric modulator of FIG. 1. For MEMS interferometric modulators, the row/column (i.e., common/segment) write procedure may take advantage of a hysteresis property of these devices as illustrated in FIG. 3. An interferometric modulator may require, for example, about a 10-volt potential difference to cause the movable reflective layer, or mirror, to change from the relaxed state to the actuated state. When the voltage is reduced from that value, the movable reflective layer maintains its state as the voltage drops back below, e.g., 10-volts, however, the movable reflective layer does not relax completely until the voltage drops below 2-volts. Thus, a range of voltage, approximately 3 to 7-volts, as shown in FIG. 3, exists where there is a window of applied voltage within which the device is stable in either the relaxed or actuated state. This is referred to herein as the "hysteresis window" or "stability window." For a display array 30 having the hysteresis characteristics of FIG. 3, the row/column write procedure can be designed to address one or more rows at a time, such that during the addressing of a given row, display elements in the addressed row that are to be actuated are exposed to a voltage difference of about 10-volts, and display elements that are to be relaxed are exposed to a voltage difference of near zero volts. After addressing, the display elements are exposed to a steady state or bias voltage difference of approximately 5-volts such that they remain in the previous strobing state. In this example, after being addressed, each display element sees a potential difference within the "stability window" of about 3-7-volts. This hysteresis property feature enables the display element design, e.g., illustrated in FIG. 1, to remain stable in either an actuated or relaxed pre-existing state under the same applied voltage conditions. Since each IMOD display element, whether in the actuated or relaxed state, is essentially a capacitor formed by the fixed and moving reflective layers, this stable state can be held at a steady voltage within the hysteresis window without substantially consuming or losing power. Moreover, essentially little or no current flows into the IMOD display element if the applied voltage potential remains substantially fixed.

In some implementations, a frame of an image may be created by applying data signals in the form of "segment" voltages along the set of column electrodes, in accordance with the desired change (if any) to the state of the display elements in a given row. Each row of the array can be addressed in turn, such that the frame is written one row at a time. To write the desired data to the display elements in a first row, segment voltages corresponding to the desired state of the display elements in the first row can be applied on the column electrodes, and a first row pulse in the form of a specific "common" voltage or signal can be applied to the first row electrode. The set of segment voltages can then be changed to correspond to the desired change (if any) to the state of the display elements in the second row, and a second common voltage can be applied to the second row electrode. In some implementations, the display elements in the first row are unaffected by the change in the segment voltages applied along the column electrodes, and remain in the state they were set to during the first common voltage row pulse. This process may be repeated for the entire series of rows, or alternatively, columns, in a sequential fashion to produce the image frame. The frames can be refreshed and/or updated with new image data by continually repeating this process at some desired number of frames per second. Each segment voltage and common voltage that is used in the data writing and/or maintaining process as described herein is referred to as a "drive scheme voltage."

The combination of segment and common signals applied across each display element (that is, the potential difference across each display element) determines the resulting state of each display element. FIG. 4 shows an example of a table illustrating various states of an interferometric modulator when various common and segment voltages are applied. As will be readily understood by one having ordinary skill in the art, the "segment" voltages can be applied to either the column electrodes or the row electrodes, and the "common" voltages can be applied to the other of the column electrodes or the row electrodes.

As illustrated in FIG. 4 (as well as in the timing diagram shown in FIG. 5B), when a release voltage $VC_{REL}$ is applied along a common line, all interferometric modulator elements along the common line will be placed in a relaxed state, alternatively referred to as a released or unactuated state, regardless of the voltage applied along the segment lines, i.e., high segment voltage $VS_H$ and low segment voltage $VS_L$. In particular, when the release voltage $VC_{REL}$ is applied along a common line, the potential voltage across the modulator (alternatively referred to as a display element voltage) is within the relaxation window (see FIG. 3, also referred to as a release window) both when the high segment voltage $VS_H$ and the low segment voltage $VS_L$ are applied along the corresponding segment line for that display element.

When a hold voltage is applied on a common line, such as a high hold voltage $VC_{HOLD_H}$ or a low hold voltage $VC_{HOLD_L}$, the state of the interferometric modulator will remain constant. For example, a relaxed IMOD will remain in a relaxed position, and an actuated IMOD will remain in an actuated position. The hold voltages can be selected such that the display element voltage will remain within a stability window both when the high segment voltage $VS_H$ and the low segment voltage $VS_L$ are applied along the corresponding segment line. Thus, the segment voltage swing, i.e., the difference between the high $VS_H$ and low segment voltage $VS_L$, is less than the width of either the positive or the negative stability window.

When an addressing, or actuation, voltage is applied on a common line, such as a high addressing voltage $VC_{ADD_H}$ or a low addressing voltage $VC_{ADD_L}$, data can be selectively written to the modulators along that line by application of segment voltages along the respective segment lines. The segment voltages may be selected such that actuation is dependent upon the segment voltage applied. When an addressing voltage is applied along a common line, application of one segment voltage will result in a display element voltage within a stability window, causing the display element to remain unactuated. In contrast, application of the other segment voltage will result in a display element voltage beyond the stability window, resulting in actuation of the display element. The particular segment voltage which causes actuation can vary depending upon which addressing voltage is used. In some implementations, when the high addressing voltage $VC_{ADD_H}$ is applied along the common line, application of the high segment voltage $VS_H$ can cause a modulator to remain in its current position, while application of the low segment voltage $VS_L$ can cause actuation of the modulator. As a corollary, the effect of the segment voltages can be the opposite when a low addressing voltage $VC_{ADD_L}$, is applied, with high segment voltage $VS_H$ causing actuation of the modulator, and low segment voltage $VS_L$ having no effect (i.e., remaining stable) on the state of the modulator.

In some implementations, hold voltages, address voltages, and segment voltages may be used which always produce the same polarity potential difference across the modulators. In some other implementations, signals can be used which alternate the polarity of the potential difference of the modulators. Alternation of the polarity across the modulators (that is, alternation of the polarity of write procedures) may reduce or inhibit charge accumulation which could occur after repeated write operations of a single polarity.

Figure 5A:
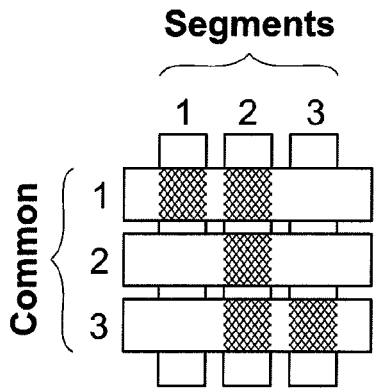
FIG. 5A shows an example of a diagram illustrating a frame of display data in the 3×3 interferometric modulator display of FIG. 2.
Figure 5B:
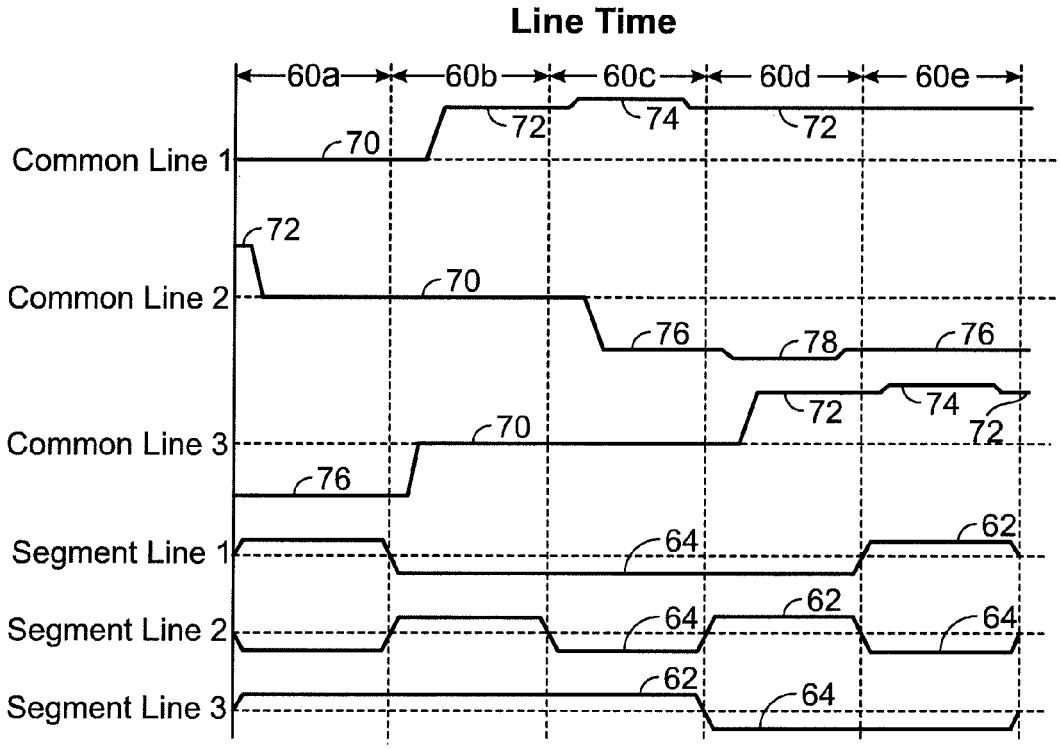
FIG. 5B shows an example of a timing diagram for common and segment signals that may be used to write the frame of display data illustrated in FIG. 5A.

FIG. 5A shows an example of a diagram illustrating a frame of display data in the 3×3 interferometric modulator display of FIG. 2. FIG. 5B shows an example of a timing diagram for common and segment signals that may be used to write the frame of display data illustrated in FIG. 5A. The signals can be applied to the, e.g., 3×3 array of FIG. 2, which will ultimately result in the line time 60*e* display arrangement illustrated in FIG. 5A. The actuated modulators in FIG. 5A are in a dark-state, i.e., where a substantial portion of the reflected light is outside of the visible spectrum so as to result in a dark appearance to, e.g., a viewer. Prior to writing the frame illustrated in FIG. 5A, the display elements can be in any state, but the write procedure illustrated in the timing diagram of FIG. 5B presumes that each modulator has been released and resides in an unactuated state before the first line time 60*a*.

During the first line time 60*a*: a release voltage 70 is applied on common line 1; the voltage applied on common line 2 begins at a high hold voltage 72 and moves to a release voltage 70; and a low hold voltage 76 is applied along common line 3. Thus, the modulators (common 1, segment 1), (1,2) and (1,3) along common line 1 remain in a relaxed, or unactuated, state for the duration of the first line time 60*a*, the modulators (2,1), (2,2) and (2,3) along common line 2 will move to a relaxed state, and the modulators (3,1), (3,2) and (3,3) along common line 3 will remain in their previous state. With reference to FIG. 4, the segment voltages applied along segment lines 1, 2 and 3 will have no effect on the state of the interferometric modulators, as none of common lines 1, 2 or 3 are being exposed to voltage levels causing actuation during line time 60*a* (i.e., $VC_{REL}$—relax and $VC_{HOLD_L}$—stable).

During the second line time 60*b*, the voltage on common line 1 moves to a high hold voltage 72, and all modulators along common line 1 remain in a relaxed state regardless of the segment voltage applied because no addressing, or actuation, voltage was applied on the common line 1. The modulators along common line 2 remain in a relaxed state due to the application of the release voltage 70, and the modulators (3,1), (3,2) and (3,3) along common line 3 will relax when the voltage along common line 3 moves to a release voltage 70.

During the third line time 60*c*, common line 1 is addressed by applying a high address voltage 74 on common line 1. Because a low segment voltage 64 is applied along segment lines 1 and 2 during the application of this address voltage, the display element voltage across modulators (1,1) and (1,2) is greater than the high end of the positive stability window (i.e., the voltage differential exceeded a predefined threshold) of the modulators, and the modulators (1,1) and (1,2) are actuated. Conversely, because a high segment voltage 62 is applied along segment line 3, the display element voltage across modulator (1,3) is less than that of modulators (1,1) and (1,2), and remains within the positive stability window of the modulator; modulator (1,3) thus remains relaxed. Also during line time 60*c*, the voltage along common line 2 decreases to a low hold voltage 76, and the voltage along common line 3 remains at a release voltage 70, leaving the modulators along common lines 2 and 3 in a relaxed position.

During the fourth line time 60*d*, the voltage on common line 1 returns to a high hold voltage 72, leaving the modulators along common line 1 in their respective addressed states. The voltage on common line 2 is decreased to a low address voltage 78. Because a high segment voltage 62 is applied along segment line 2, the display element voltage across modulator (2,2) is below the lower end of the negative stability window of the modulator, causing the modulator (2,2) to actuate. Conversely, because a low segment voltage 64 is applied along segment lines 1 and 3, the modulators (2,1) and (2,3) remain in a relaxed position. The voltage on common line 3 increases to a high hold voltage 72, leaving the modulators along common line 3 in a relaxed state.

Finally, during the fifth line time 60*e*, the voltage on common line 1 remains at high hold voltage 72, and the voltage on common line 2 remains at a low hold voltage 76, leaving the modulators along common lines 1 and 2 in their respective addressed states. The voltage on common line 3 increases to a high address voltage 74 to address the modulators along common line 3. As a low segment voltage 64 is applied on segment lines 2 and 3, the modulators (3,2) and (3,3) actuate, while the high segment voltage 62 applied along segment line 1 causes modulator (3,1) to remain in a relaxed position. Thus, at the end of the fifth line time 60*e*, the 3×3 display element array is in the state shown in FIG. 5A, and will remain in that state as long as the hold voltages are applied along the common lines, regardless of variations in the segment voltage which may occur when modulators along other common lines (not shown) are being addressed.

In the timing diagram of FIG. 5B, a given write procedure (i.e., line times 60*a*-60*e*) can include the use of either high hold and address voltages, or low hold and address voltages. Once the write procedure has been completed for a given common line (and the common voltage is set to the hold voltage having the same polarity as the actuation voltage), the display element voltage remains within a given stability window, and does not pass through the relaxation window until a release voltage is applied on that common line. Furthermore, as each modulator is released as part of the write procedure prior to addressing the modulator, the actuation time of a modulator, rather than the release time, may determine the necessary line time. Specifically, in implementations in which the release time of a modulator is greater than the actuation time, the release voltage may be applied for longer than a single line time, as depicted in FIG. 5B. In some other implementations, voltages applied along common lines or segment lines may vary to account for variations in the actuation and release voltages of different modulators, such as modulators of different colors.

Figure 6A:
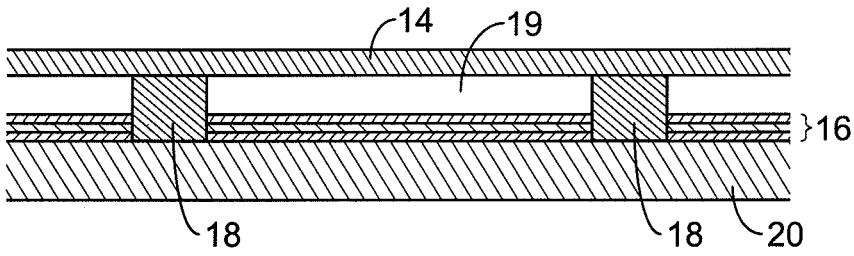
FIG. 6A shows an example of a partial cross-section of the interferometric modulator display of FIG. 1.
Figure 6B:
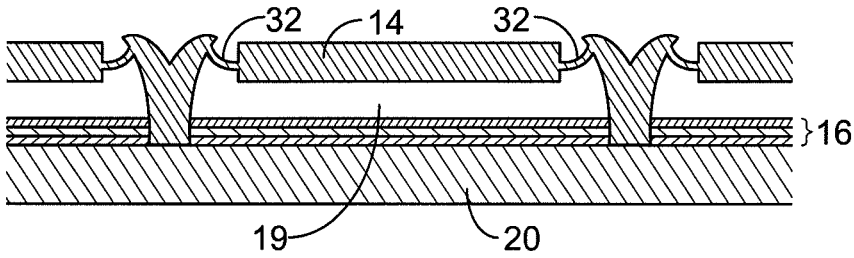
FIGS. 6B-6E show examples of cross-sections of varying implementations of interferometric modulators.
Figure 6C:
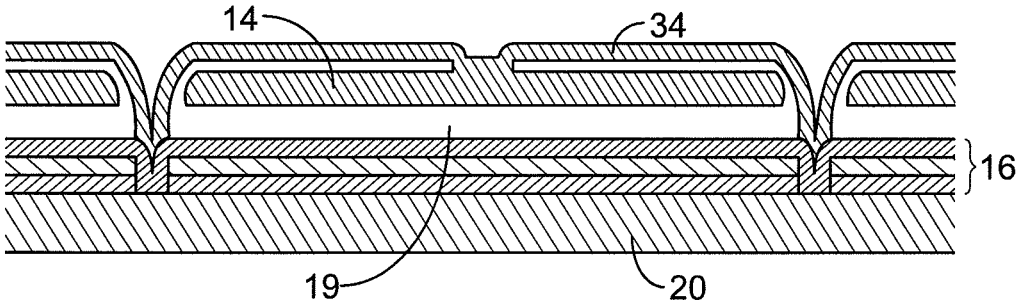

The details of the structure of interferometric modulators that operate in accordance with the principles set forth above may vary widely. For example, FIGS. 6A-6E show examples of cross-sections of varying implementations of interferometric modulators, including the movable reflective layer 14 and its supporting structures. FIG. 6A shows an example of a partial cross-section of the interferometric modulator display of FIG. 1, where a strip of metal material, i.e., the movable reflective layer 14 is deposited on supports 18 extending orthogonally from the substrate 20. In FIG. 6B, the movable reflective layer 14 of each IMOD is generally square or rectangular in shape and attached to supports at or near the corners, on tethers 32. In FIG. 6C, the movable reflective layer 14 is generally square or rectangular in shape and suspended from a deformable layer 34, which may include a flexible metal. The deformable layer 34 can connect, directly or indirectly, to the substrate 20 around the perimeter of the movable reflective layer 14. These connections are herein referred to as support posts. The implementation shown in FIG. 6C has additional benefits deriving from the decoupling of the optical functions of the movable reflective layer 14 from its mechanical functions, which are carried out by the deformable layer 34. This decoupling allows the structural design and materials used for the reflective layer 14 and those used for the deformable layer 34 to be optimized independently of one another.

Figure 6D:
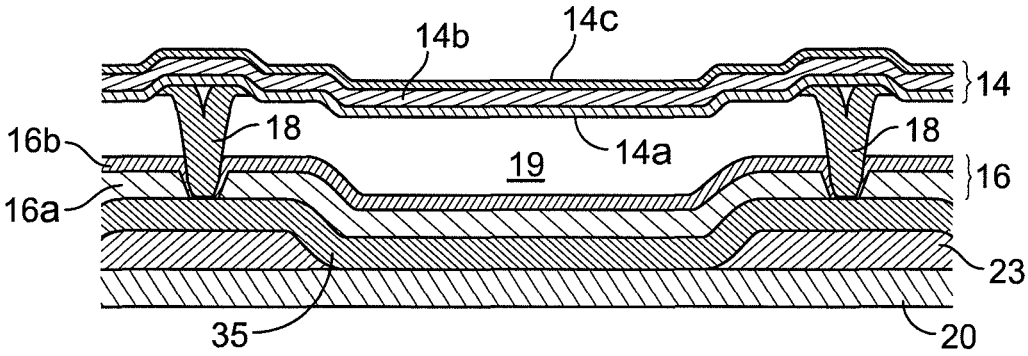

FIG. 6D shows another example of an IMOD, where the movable reflective layer 14 includes a reflective sub-layer 14*a*. The movable reflective layer 14 rests on a support structure, such as support posts 18. The support posts 18 provide separation of the movable reflective layer 14 from the lower stationary electrode (i.e., part of the optical stack 16 in the illustrated IMOD) so that a gap 19 is formed between the movable reflective layer 14 and the optical stack 16, for example when the movable reflective layer 14 is in a relaxed position. The movable reflective layer 14 also can include a conductive layer 14*c*, which may be configured to serve as an electrode, and a support layer 14*b*. In this example, the conductive layer 14*c* is disposed on one side of the support layer 14*b*, distal from the substrate 20, and the reflective sub-layer 14*a* is disposed on the other side of the support layer 14*b*, proximal to the substrate 20. In some implementations, the reflective sub-layer 14*a* can be conductive and can be disposed between the support layer 14*b* and the optical stack 16. The support layer 14*b* can include one or more layers of a dielectric material, for example, silicon oxynitride (SiON) or silicon dioxide ($SiO_2$). In some implementations, the support layer 14*b* can be a stack of layers, such as, for example, a $SiO_2$/SiON/$SiO_2$ tri-layer stack. Either or both of the reflective sub-layer 14*a* and the conductive layer 14*c* can include, e.g., an aluminum (Al) alloy with about 0.5% copper (Cu), or another reflective metallic material. Employing conductive layers 14*a*, 14*c* above and below the dielectric support layer 14*b* can balance stresses and provide enhanced conduction. In some implementations, the reflective sub-layer 14*a* and the conductive layer 14*c* can be formed of different materials for a variety of design purposes, such as achieving specific stress profiles within the movable reflective layer 14.

As illustrated in FIG. 6D, some implementations also can include a black mask structure 23. The black mask structure 23 can be formed in optically inactive regions (e.g., between display elements or under posts 18) to absorb ambient or stray light. The black mask structure 23 also can improve the optical properties of a display device by inhibiting light from being reflected from or transmitted through inactive portions of the display, thereby increasing the contrast ratio. Additionally, the black mask structure 23 can be conductive and be configured to function as an electrical bussing layer. In some implementations, the row electrodes can be connected to the black mask structure 23 to reduce the resistance of the connected row electrode. The black mask structure 23 can be formed using a variety of methods, including deposition and patterning techniques. The black mask structure 23 can include one or more layers. For example, in some implementations, the black mask structure 23 includes a molybdenum-chromium (MoCr) layer that serves as an optical absorber, a layer, and an aluminum alloy that serves as a reflector and a bussing layer, with a thickness in the range of about 30-80 Å, 500-1000 Å, and 500-6000 Å, respectively. The one or more layers can be patterned using a variety of techniques, including photolithography and dry etching, including, for example, carbon tetrafluoromethane ($CF_4$) and/or oxygen ($O_2$) for the MoCr and $SiO_2$ layers and chlorine ($Cl_2$) and/or boron trichloride ($BCl_3$) for the aluminum alloy layer. In some implementations, the black mask 23 can be an etalon or interferometric stack structure. In such interferometric stack black mask structures 23, the conductive absorbers can be used to transmit or bus signals between lower, stationary electrodes in the optical stack 16 of each row or column. In some implementations, a spacer layer 35 can serve to generally electrically isolate the absorber layer 16*a* from the conductive layers in the black mask 23.

Figure 6E:
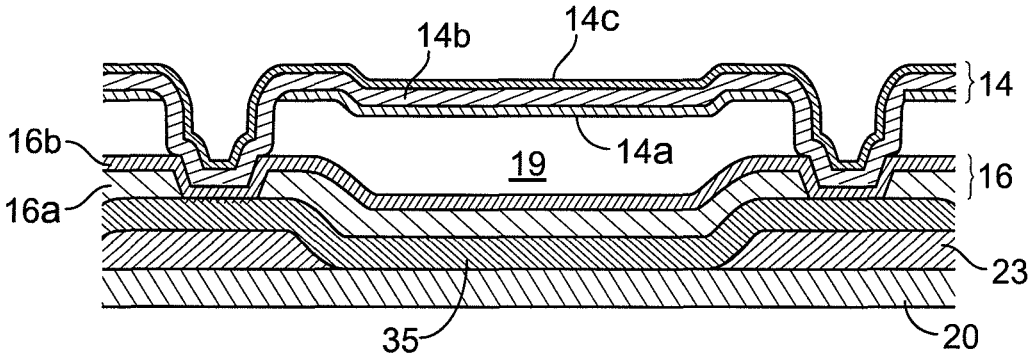

FIG. 6E shows another example of an IMOD, where the movable reflective layer 14 is self supporting. In contrast with FIG. 6D, the implementation of FIG. 6E does not include support posts 18. Instead, the movable reflective layer 14 contacts the underlying optical stack 16 at multiple locations, and the curvature of the movable reflective layer 14 provides sufficient support that the movable reflective layer 14 returns to the unactuated position of FIG. 6E when the voltage across the interferometric modulator is insufficient to cause actuation. The optical stack 16, which may contain a plurality of several different layers, is shown here for clarity including an optical absorber 16*a*, and a dielectric 16*b*. In some implementations, the optical absorber 16*a* may serve both as a fixed electrode and as a partially reflective layer.

In implementations such as those shown in FIGS. 6A-6E, the IMODs function as direct-view devices, in which images are viewed from the front side of the transparent substrate 20, i.e., the side opposite to that upon which the modulator is arranged. In these implementations, the back portions of the device (that is, any portion of the display device behind the movable reflective layer 14, including, for example, the deformable layer 34 illustrated in FIG. 6C) can be configured and operated upon without impacting or negatively affecting the image quality of the display device, because the reflective layer 14 optically shields those portions of the device. For example, in some implementations a bus structure (not illustrated) can be included behind the movable reflective layer 14 which provides the ability to separate the optical properties of the modulator from the electromechanical properties of the modulator, such as voltage addressing and the movements that result from such addressing. Additionally, the implementations of FIGS. 6A-6E can simplify processing, such as, e.g., patterning.

Figure 7:
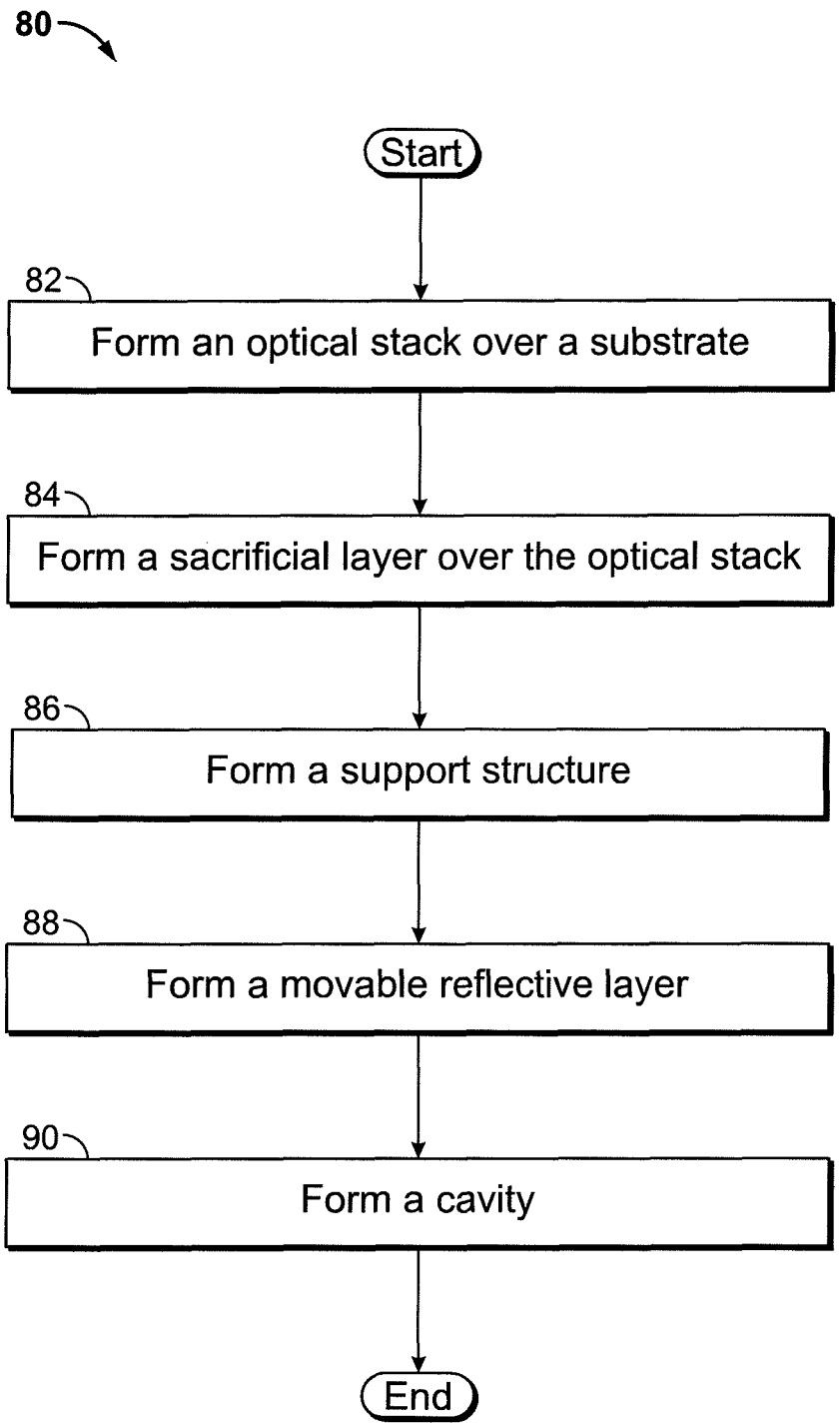
FIG. 7 shows an example of a flow diagram illustrating a manufacturing process for an interferometric modulator.
Figure 8A:
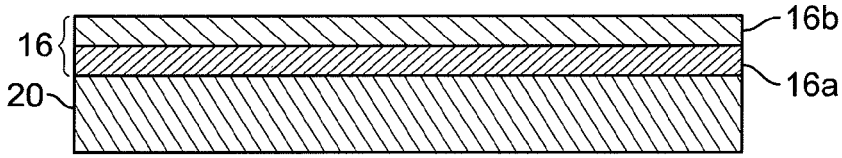
FIGS. 8A-8E show examples of cross-sectional schematic illustrations of various stages in a method of making an interferometric modulator.

FIG. 7 shows an example of a flow diagram illustrating a manufacturing process 80 for an interferometric modulator, and FIGS. 8A-8E show examples of cross-sectional schematic illustrations of corresponding stages of such a manufacturing process 80. In some implementations, the manufacturing process 80 can be implemented to manufacture, e.g., interferometric modulators of the general type illustrated in FIGS. 1 and 6, in addition to other blocks not shown in FIG. 7. With reference to FIGS. 1, 6 and 7, the process 80 begins at block 82 with the formation of the optical stack 16 over the substrate 20. FIG. 8A illustrates such an optical stack 16 formed over the substrate 20. The substrate 20 may be a transparent substrate such as glass or plastic, it may be flexible or relatively stiff and unbending, and may have been subjected to prior preparation processes, e.g., cleaning, to facilitate efficient formation of the optical stack 16. As discussed above, the optical stack 16 can be electrically conductive, partially transparent and partially reflective and may be fabricated, for example, by depositing one or more layers having the desired properties onto the transparent substrate 20. In FIG. 8A, the optical stack 16 includes a multilayer structure having sub-layers 16*a* and 16*b*, although more or fewer sub-layers may be included in some other implementations. In some implementations, one of the sub-layers 16*a*, 16*b* can be configured with both optically absorptive and conductive properties, such as the combined conductor/absorber sub-layer 16*a*. Additionally, one or more of the sub-layers 16*a*, 16*b* can be patterned into parallel strips, and may form row electrodes in a display device. Such patterning can be performed by a masking and etching process or another suitable process known in the art. In some implementations, one of the sub-layers 16*a*, 16*b* can be an insulating or dielectric layer, such as sub-layer 16*b* that is deposited over one or more metal layers (e.g., one or more reflective and/or conductive layers). In addition, the optical stack 16 can be patterned into individual and parallel strips that form the rows of the display.

Figure 8B:
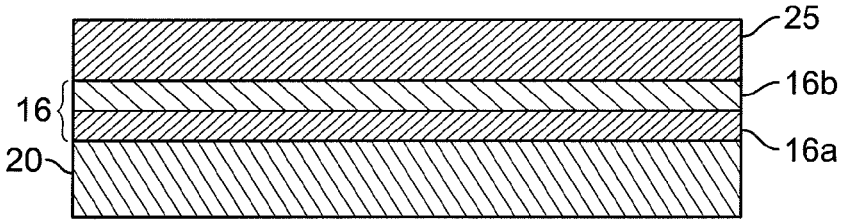

The process 80 continues at block 84 with the formation of a sacrificial layer 25 over the optical stack 16. The sacrificial layer 25 is later removed (e.g., at block 90) to form the cavity 19 and thus the sacrificial layer 25 is not shown in the resulting interferometric modulators 12 illustrated in FIG. 1. FIG. 8B illustrates a partially fabricated device including a sacrificial layer 25 formed over the optical stack 16. The formation of the sacrificial layer 25 over the optical stack 16 may include deposition of a xenon difluoride ($XeF_2$)-etchable material such as molybdenum (Mo) or amorphous silicon (a-Si), in a thickness selected to provide, after subsequent removal, a gap or cavity 19 (see also FIGS. 1 and 8E) having a desired design size. Deposition of the sacrificial material may be carried out using deposition techniques such as physical vapor deposition (PVD, e.g., sputtering), plasma-enhanced chemical vapor deposition (PECVD), thermal chemical vapor deposition (thermal CVD), or spin-coating.

Figure 8C:
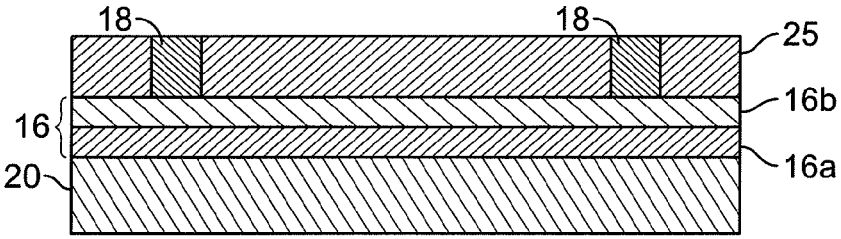

The process 80 continues at block 86 with the formation of a support structure e.g., a post 18 as illustrated in FIGS. 1, 6 and 8C. The formation of the post 18 may include patterning the sacrificial layer 25 to form a support structure aperture, then depositing a material (e.g., a polymer or an inorganic material, e.g., silicon oxide) into the aperture to form the post 18, using a deposition method such as PVD, PECVD, thermal CVD, or spin-coating. In some implementations, the support structure aperture formed in the sacrificial layer can extend through both the sacrificial layer 25 and the optical stack 16 to the underlying substrate 20, so that the lower end of the post 18 contacts the substrate 20 as illustrated in FIG. 6A. Alternatively, as depicted in FIG. 8C, the aperture formed in the sacrificial layer 25 can extend through the sacrificial layer 25, but not through the optical stack 16. For example, FIG. 8E illustrates the lower ends of the support posts 18 in contact with an upper surface of the optical stack 16. The post 18, or other support structures, may be formed by depositing a layer of support structure material over the sacrificial layer 25 and patterning portions of the support structure material located away from apertures in the sacrificial layer 25. The support structures may be located within the apertures, as illustrated in FIG. 8C, but also can, at least partially, extend over a portion of the sacrificial layer 25. As noted above, the patterning of the sacrificial layer 25 and/or the support posts 18 can be performed by a patterning and etching process, but also may be performed by alternative etching methods.

Figure 8D:
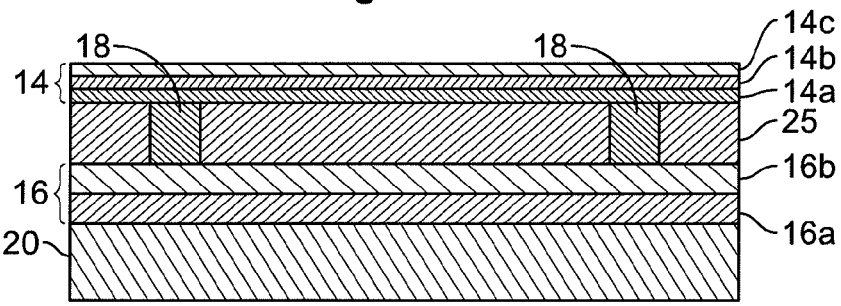
Figure 8E:
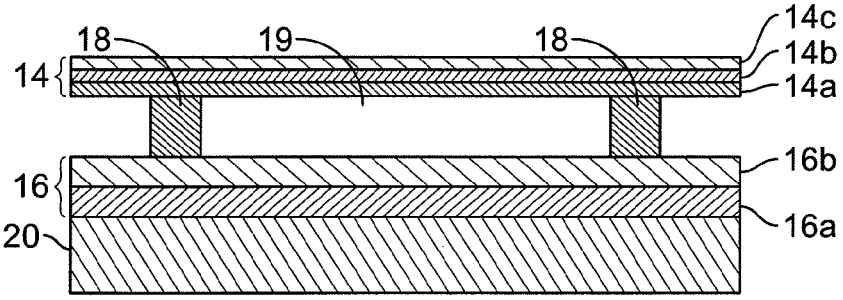

The process 80 continues at block 88 with the formation of a movable reflective layer or membrane such as the movable reflective layer 14 illustrated in FIGS. 1, 6 and 8D. The movable reflective layer 14 may be formed by employing one or more deposition steps, e.g., reflective layer (e.g., aluminum, aluminum alloy) deposition, along with one or more patterning, masking, and/or etching steps. The movable reflective layer 14 can be electrically conductive, and referred to as an electrically conductive layer. In some implementations, the movable reflective layer 14 may include a plurality of sub-layers 14*a*, 14*b*, 14*c* as shown in FIG. 8D. In some implementations, one or more of the sub-layers, such as sub-layers 14*a*, 14*c*, may include highly reflective sub-layers selected for their optical properties, and another sub-layer 14*b* may include a mechanical sub-layer selected for its mechanical properties. Since the sacrificial layer 25 is still present in the partially fabricated interferometric modulator formed at block 88, the movable reflective layer 14 is typically not movable at this stage. A partially fabricated IMOD that contains a sacrificial layer 25 may also be referred to herein as an "unreleased" IMOD. As described above in connection with FIG. 1, the movable reflective layer 14 can be patterned into individual and parallel strips that form the columns of the display.

The process 80 continues at block 90 with the formation of a cavity, e.g., cavity 19 as illustrated in FIGS. 1, 6 and 8E. The cavity 19 may be formed by exposing the sacrificial material 25 (deposited at block 84) to an etchant. For example, an etchable sacrificial material such as Mo or amorphous Si may be removed by dry chemical etching, e.g., by exposing the sacrificial layer 25 to a gaseous or vaporous etchant, such as vapors derived from solid $XeF_2$ for a period of time that is effective to remove the desired amount of material, typically selectively removed relative to the structures surrounding the cavity 19. Other etching methods, e.g. wet etching and/or plasma etching, also may be used. Since the sacrificial layer 25 is removed during block 90, the movable reflective layer 14 is typically movable after this stage. After removal of the sacrificial material 25, the resulting fully or partially fabricated IMOD may be referred to herein as a "released" IMOD.

Figure 9:
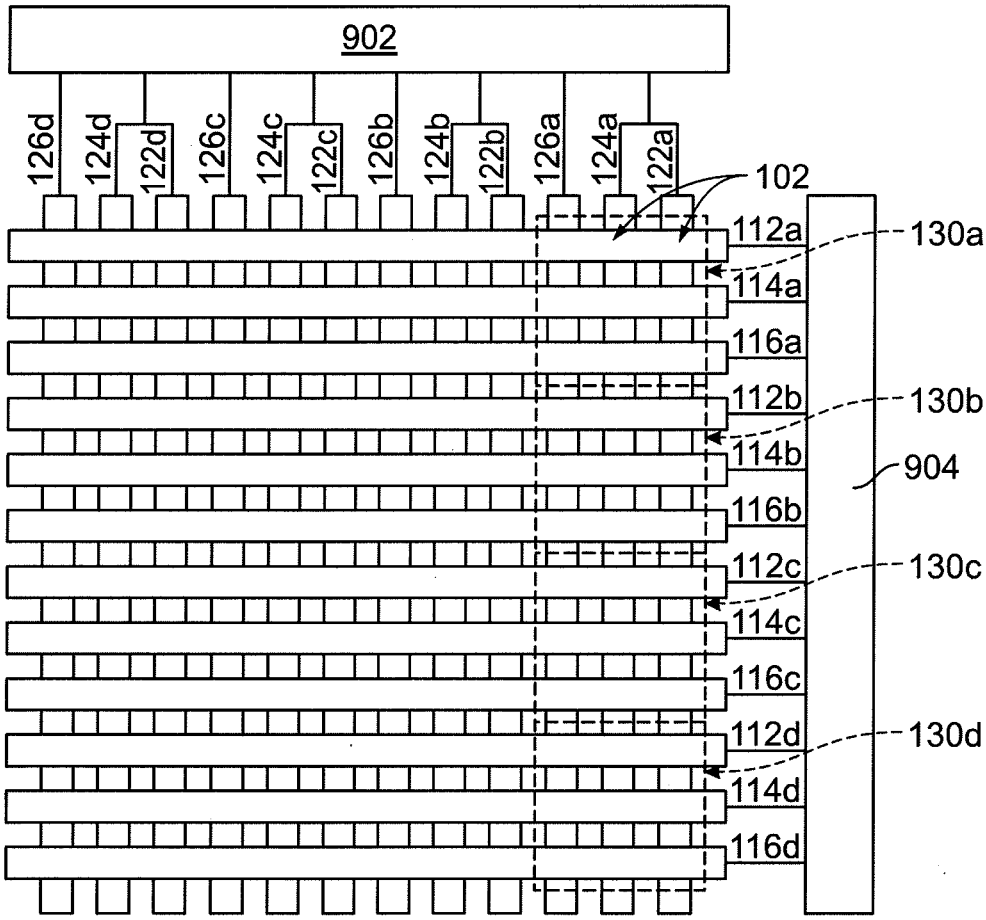
FIG. 9 is a block diagram illustrating examples of a common driver and a segment driver for driving an implementation of a 64 color per pixel display.

FIG. 9 is a block diagram illustrating examples of a common driver 904 and a segment driver 902 for driving an implementation of a 64 color per pixel display. The array can include a set of electromechanical display elements 102, which in some implementations may include interferometric modulators. A set of segment electrodes or segment lines 122*a*-122*d*, 124*a*-124*d*, 126*a*-126*d* and a set of common electrodes or common lines 112*a*-112*d*, 114*a*-114*d*, 116*a*-116*d* can be used to address the display elements 102, as each display element will be in electrical communication with multiple segment electrodes and a common electrodes. Segment driver circuitry 902 is configured to apply voltage waveforms across each of the segment electrodes, and common driver circuitry 904 is configured to apply voltage waveforms across each of the column electrodes. In some implementations, some of the segment electrodes may be in electrical communication with one another, such as segment electrodes 122*a* and 124*a*, such that the same voltage waveform can be simultaneously applied across each of the segment electrodes. Because it is coupled to two segment electrodes, the segment driver outputs connected to two segment electrodes may be referred to herein as a "most significant bit" (MSB) segment output since the state of this segment output controls the state of two adjacent display elements in each row. Segment driver outputs coupled to individual segment electrodes such as at 126*a* may be referred to herein as "least significant bit" (LSB) electrodes since they control the state of a single display element in each row.

Still with reference to FIG. 9, in an implementation in which the display includes a color display or a monochrome grayscale display, groups of electromechanical elements 102 may form pixels that can display a range of colors or grayscales. As used herein, a display element refers to a single device that is put into a defined state during an image writing process. An example is an individual interferometric modulator that can be put into either a reflecting or absorbing state. A pixel is a collection of one or more display elements that are used to visually represent a certain piece or region of image data. For a color or gray scale display, each input pixel of image data may be mapped to a group of display elements defining an array pixel that is used to produce (either directly or in combination with surrounding pixels) a visual representation of the gray level or color defined by the image data. Although it is possible for a single display element to function by itself as a pixel, groups of display elements, usually having different colors, are most commonly used.

In an implementation in which the array includes a color display, the various colors may be aligned along common lines, such that substantially all of the display elements along a given common line include display elements configured to display the same color. Some implementations of color displays include alternating lines of red, green, and blue display elements. For example, lines 112*a*-112*d* may correspond to lines of red interferometric modulators, lines 114*a*-114*d* may correspond to lines of green interferometric modulators, and lines 116*a*-116*d* may correspond to lines of blue interferometric modulators. In one implementation, each 3×3 array of interferometric modulators 102 forms a pixel such as pixels 130*a*-130*d*. In the illustrated implementation in which two of the segment electrodes are shorted to one another, such a 3×3 pixel will be capable of rendering 64 different colors (e.g., a 6-bit color depth), because each set of three common color display elements along each common electrode in each pixel can be placed in four different states, corresponding to none, one, two, or three actuated interferometric modulators. When using this arrangement in a monochrome grayscale mode, the state of the three pixel sets for each color are made to be identical, in which case each pixel can take on four different gray level intensities. It will be appreciated that this is just one example, and that larger groups of interferometric modulators may be used to form pixels having a greater color range with different overall pixel count or resolution.

As described in detail above, to write a line of display data, the segment driver 902 may apply voltages to the segment electrodes or buses connected thereto. Thereafter, the common driver 904 may pulse a selected common line connected thereto to cause the display elements along the selected line to display the data, for example by actuating selected display elements along the line in accordance with the voltages applied to the respective segment outputs.

After display data is written to the selected line, the segment driver 902 may apply another set of voltages to the buses connected thereto, and the common driver 904 may pulse another line connected thereto to write display data to the other line. By repeating this process, display data may be sequentially written to any number of lines in the display array.

The time of writing display data (a.k.a. the write time) to the display array using such process is generally proportional to the number of lines of display data being written. In many applications, however, it may be advantageous to reduce the write time, for example to increase the frame rate of a display or reduce any perceivable flicker.

Figure 10:
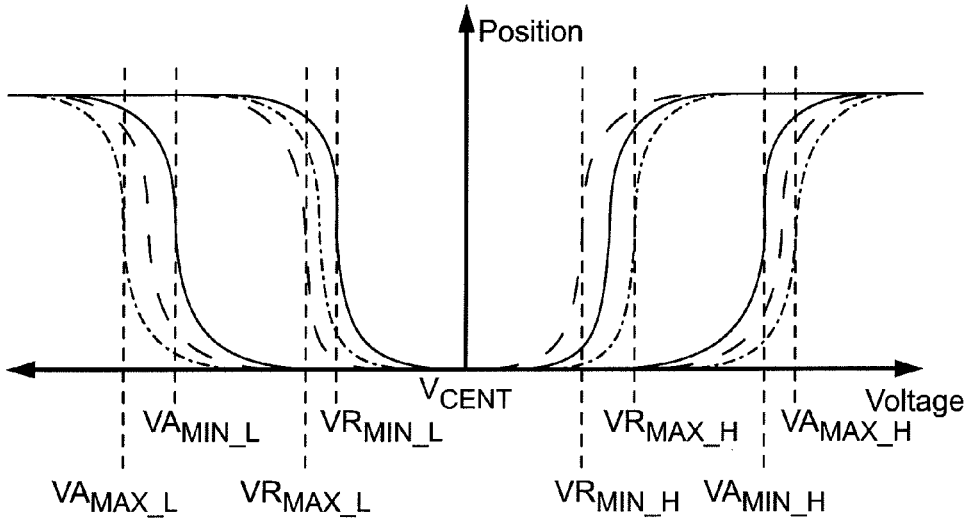
FIG. 10 shows an example of a diagram illustrating movable reflective mirror position versus applied voltage for several members of an array of interferometric modulators.

FIG. 10 shows an example of a diagram illustrating movable reflective mirror position versus applied voltage for several members of an array of interferometric modulators. FIG. 10 is similar to FIG. 3, but illustrates variations in hysteresis curves among different modulators in the array. As used herein, the term "drive response characteristic" refers to a characteristic of the response of the display element to an applied electrical signal. For the interferometric modulator display elements described herein, the applied signal is a voltage, and the drive response characteristics relate to the shape and position of the hysteresis curve(s) for one or a group of display elements. Although each interferometric modulator generally exhibits hysteresis, the edges of the hysteresis window are not at identical voltages for all modulators of the array Thus, the actuation voltages and release voltages may be different for different interferometric modulators in an array, even for interferometric modulators that are intended to be nominally identical. This non-uniformity may arise, for example, from slight differences in material thicknesses or other properties in different parts of the array that inevitably occur in the manufacturing process. In addition, the actuation voltages and release voltages can change with variations in temperature, aging, and use patterns of the display over its lifetime. This can make it difficult to determine voltages to be used in a drive scheme, such as the drive scheme described above with respect to FIG. 4. This can also make it useful for optimal display operation to vary the voltages used in a drive scheme in a manner that tracks these changes during use and over the life of the display array.

Returning now to FIG. 10, at a positive actuation voltage above a center voltage (denoted as $V_{CENT}$ in FIG. 11) and at a negative actuation voltage below the center voltage, each interferometric modulator changes from a released state to an actuated state. The center voltage is the midpoint between the positive hysteresis window and the negative hysteresis window. It can be defined in a variety of ways, e.g., halfway between the outer edges, halfway between the inner edges, or halfway between the midpoints of the two windows. For an array of modulators, the center voltage may be defined as the average center voltage for the different modulators of the array, or may be defined as midway between the extremes of the hysteresis windows for all the modulators. For example, with reference to FIG. 10, the center voltage may be defined as midway between the high actuation voltage and the low actuation voltage. As a practical matter, it is not particularly important how this value is determined, since the center voltage for an interferometric modulator is typically close to zero, and even when this is not the case, the various methods of calculating a midpoint between hysteresis windows will arrive at substantially the same value. In those implementations where the center voltage is offset from zero, this deviation may be referred to as the voltage offset.

As described above, these values are different for different interferometric modulators. It is possible to characterize maximum positive and negative actuation voltage for the array, designated $VA_{MAX_H}$ and $VA_{MAX_L}$ respectively in FIG. 10. The voltage $VA_{MAX_H}$ can be characterized as the positive polarity voltage that would cause all of the modulators of an array (or selected portion of an array as described further below) to actuate. The voltage $VA_{MAX_L}$ can be characterized as the negative polarity voltage that would cause all of the modulators of an array (or portion of the array) to actuate. Using this terminology, the center voltage $V_{CENT}$ may be defined as $(VA_{MAX_H}\ VA_{MAX_L})/2$. Each of these parameters are examples of drive response characteristics of display elements of the array.

It is also possible to characterize minimum positive and negative actuation voltage for the array, designated $VA_{MIN_H}$ and $VA_{MIN_L}$ respectively in FIG. 10. The voltage $VA_{MIN_H}$ can be characterized as the positive polarity voltage that would cause only the first one of the modulators of an array (or selected portion of the array) to actuate. The voltage $VA_{MIN_L}$ can be characterized as the negative polarity voltage that would cause only the first one of the modulators of an array (or selected portion of the array) to actuate.

As is also shown in FIG. 10, at a positive polarity release voltage above the center voltage and at a negative polarity release voltage below the center voltage, the interferometric modulator changes from the actuated state to the released state. As with the positive and negative actuation voltages, it is possible to characterize limits of the positive and negative release voltages for the array. The voltage $VR_{MAX_H}$ can be characterized as the positive polarity voltage that would cause only the first one of the modulators of an array (or selected portion of the array) to release from an actuated state. The voltage $VR_{MAX_L}$ can be characterized as the negative polarity voltage that would cause only the first one of the modulators of an array (or selected portion of the array) to release from an actuated state. The voltage $VR_{MIN_H}$ can be characterized as the positive polarity voltage that would cause all of the modulators of an array (or selected portion of the array) to release. The voltage $VR_{MIN_L}$ can be characterized as the negative polarity voltage that would cause all of the modulators of an array (or selected portion of the array) to release.

Figure 11:
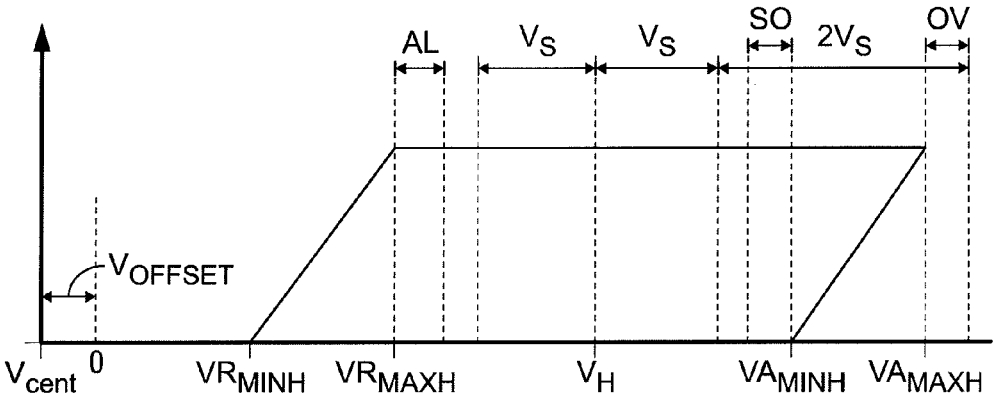
FIG. 11 shows another example of a diagram illustrating conceptually movable reflective mirror position versus applied voltage for several members of an array of interferometric modulators.

FIG. 11 shows another example of a diagram illustrating conceptually movable reflective mirror position versus applied voltage for several members of an array of interferometric modulators. FIG. 11 also shows the different drive scheme voltages and their relationship to the range of hysteresis curves present in the modulators of the array. In FIG. 11, the range of hysteresis characteristics is represented as a parallelogram, with $VA_{MAX_H}$, $VA_{MAX_L}$, $VA_{MIN_H}$, $VA_{MIN_L}$, $VR_{MAX_H}$, $VR_{MAX_L}$, $VR_{MIN_H}$, and $VR_{MIN_L}$ having the same meanings as described above. The distance ΔL in FIG. 11 is referred to as the "allowance" voltage, which is the smallest amount above $VR_{MAX_H}$ that the drive scheme may apply to the modulators during a hold state to avoid accidental release of some modulators even in the presence of noise, waveform distortions in the drive signals and the like. The distance SO in FIG. 11 is referred to as the "standoff" voltage, which is the smallest amount below $VA_{MIN_H}$ that the drive scheme may apply to the modulators during a hold state to avoid accidental actuation of some modulators even in the presence of noise, waveform distortions in the drive signals, and the like. The distance OV in FIG. 11 is referred to as the "overvoltage," which is the smallest amount above $VA_{MAX_H}$ that the drive scheme may apply to the modulators during a write state to successfully actuate each modulator when intended even in the presence of noise, waveform distortions in the drive signals and the like. Values for AL, SO, and OV are empirically or semi-empirically determined values that may depend on the properties of the modulators, manufacturing processes, etc.

As is also shown in FIG. 11, the hold voltage $V_H$ (e.g. the level 72 in FIG. 5B) is positioned near the middle of the hysteresis window. The magnitude of the segment voltage (e.g. levels 62 and 64 in FIG. 5B) is less than half the window width, or less than half the window width minus AL and SO, so that when the common line is at $V_H$, the modulator is stable regardless of whether the segment voltage is at $+V_S$ or $-V_S$. The write voltage on the common line, e.g. level 74 of FIG. 5, may be set to $V_H+2V_S$. In this case, the total potential across a modulator during a write cycle when the modulator is intended to be actuated is $V_H+3V_S$. This value should be at least $VA_{MAX_H}$+OV to reliably actuate all modulators when intended with a write pulse.

These actuation and release values for the array as well as the principles of operation described above can be used to derive suitable drive scheme voltages for the array. For explanatory purposes, a monochrome array will first be considered. Furthermore, we will assume that $V_{OFFSET}$ is zero, and the shape of the hysteresis curve is the same for both positive and negative polarities. Thus, we can analyze only one hysteresis curve in this example. In some implementations, the magnitude of a segment voltage may be derived first from these values. For a segment voltage to work properly in the drive scheme of FIG. 5, the following should be true (referring to the parameters of FIG. 11):

$$V_S \geq (VA_{MAX_H} - VA_{MIN_H} + SO + OV)/2 \quad \text{Equation 1}$$

and $$V_S \leq (VA_{MIN_H} - VR_{MAX_H} + SO + AL)/2 \quad \text{Equation 2}$$

Having a simultaneous solution to the above two equations implies that the right side of Equation 1 is smaller than the right side of Equation 2, which is normally the case. Accordingly, one can select the average of the two right sides of Equations 1 and 2 for a selected $V_S$ of:

$$V_S = (VA_{MAX_H} - VA_{MAX_H} + OV - AL)/4 \quad \text{Equation 3}$$

Once a $V_S$ is determined as above, a hold voltage (e.g. level 72 of FIG. 5B) can be derived. For many arrays, AL is larger than SO. In some implementations therefore, the hold voltage $V_H$ may be set closer to the actuation thresholds than the release thresholds as follows:

$$V_H = VA_{MIN_H} - SO - V_S \quad \text{Equation 4}$$

As one example, if $VA_{MAX_H}$ is 20V, $VA_{MIN_H}$ is 18V, $VR_{MAX_H}$ is 6V, SO is 1V, OV is 1V, and AL is 3V, the above formulas produce a $V_S$ of 3V, and a $V_H$ of 14V. Applying this example to the waveforms of FIG. 5B, levels 72 and 76 would be +14V and −14V respectively, segment voltage levels 62 and 64 would be +3V and −3V respectively, and write pulse levels 74 and 78 would be +20V and −20V respectively.

In those cases where there is a non-zero $V_{OFFSET}$, different hold voltages can be used for the different polarities (e.g. the magnitude of level 76 of FIG. 5B can be different from the magnitude of level 72 of FIG. 5B). To take this into account, the positive hold voltage may be derived as $V_{H_H} = VA_{MIN_H} - SO - V_S$, and the negative hold voltage can be derived as $V_{H_L} = VA_{MIN_L} + SO + V_S$.

When the array is a color array having different common lines of different colors as described above with reference to FIG. 9, it can be useful to use different hold voltages for different color lines of display elements. Because different color interferometric modulators have different mechanical constructions, there may be a wide variation in hysteresis curve characteristics for interferometric modulators of different colors. Within the group of modulators of one color of the array, however, more consistent hysteresis properties may be present. For a color display, different values for $VA_{MAX_H}$, $VA_{MIN_H}$, and $VR_{MAX_H}$ (and $VA_{MAX_L}$, $VA_{MIN_L}$, and $VR_{MAX_L}$ for arrays with a non-zero $V_{OFFSET}$) can be measured for each color of display elements of the array. In other words, up to six (6) voltage values may be measured for each color of display elements of the array. For a three (3) color display, there may be a total of eighteen (18) different display response characteristics. Because the segment voltages are applied along all the rows, a single segment voltage for all colors may be first derived. This may be derived similar to the above, where the right sides of Equations 1 and 2 are measured and calculated separately for each color. The selected $V_S$ may be the average of the largest value computed for a right side of Equation 1 and the smallest value computed for a right side of Equation 2 over all the colors. An alternative computation for a segment voltage may include computing a segment voltage for one or more colors separately as described above, and then selecting one of these (e.g. the smallest magnitude, the middle magnitude, the one from a particular color with visual significance, etc.) as the segment voltage for the entire array. Generally, a smaller magnitude results in lower power requirements, but in some cases a larger segment voltage will provide more margin with respect to accurate actuation of display elements. The average of the maximum and the minimum values described above is one way to balance these competing considerations. In these implementations, positive and negative hold voltages for each color can be separately derived as described above using the values of $VA_{MIN_H}$, and $VA_{MIN_L}$ measured for that color.

As mentioned above, the values for $VA_{MAX_H}$, $VA_{MAX_H}$, $VR_{MAX_H}$, $VA_{MAX_L}$ $VA_{MIN_L}$, and $VR_{MAX_L}$ may vary between different arrays due to manufacturing tolerances, and may also vary in a single array with temperature, over time, depending on use, and the like. To initially set and later adjust these voltages to produce a display that functions well over its lifetime it is possible to incorporate testing and state sensing circuitry into a display apparatus. This is illustrated in FIGS. 12 and 13.

Figure 12:
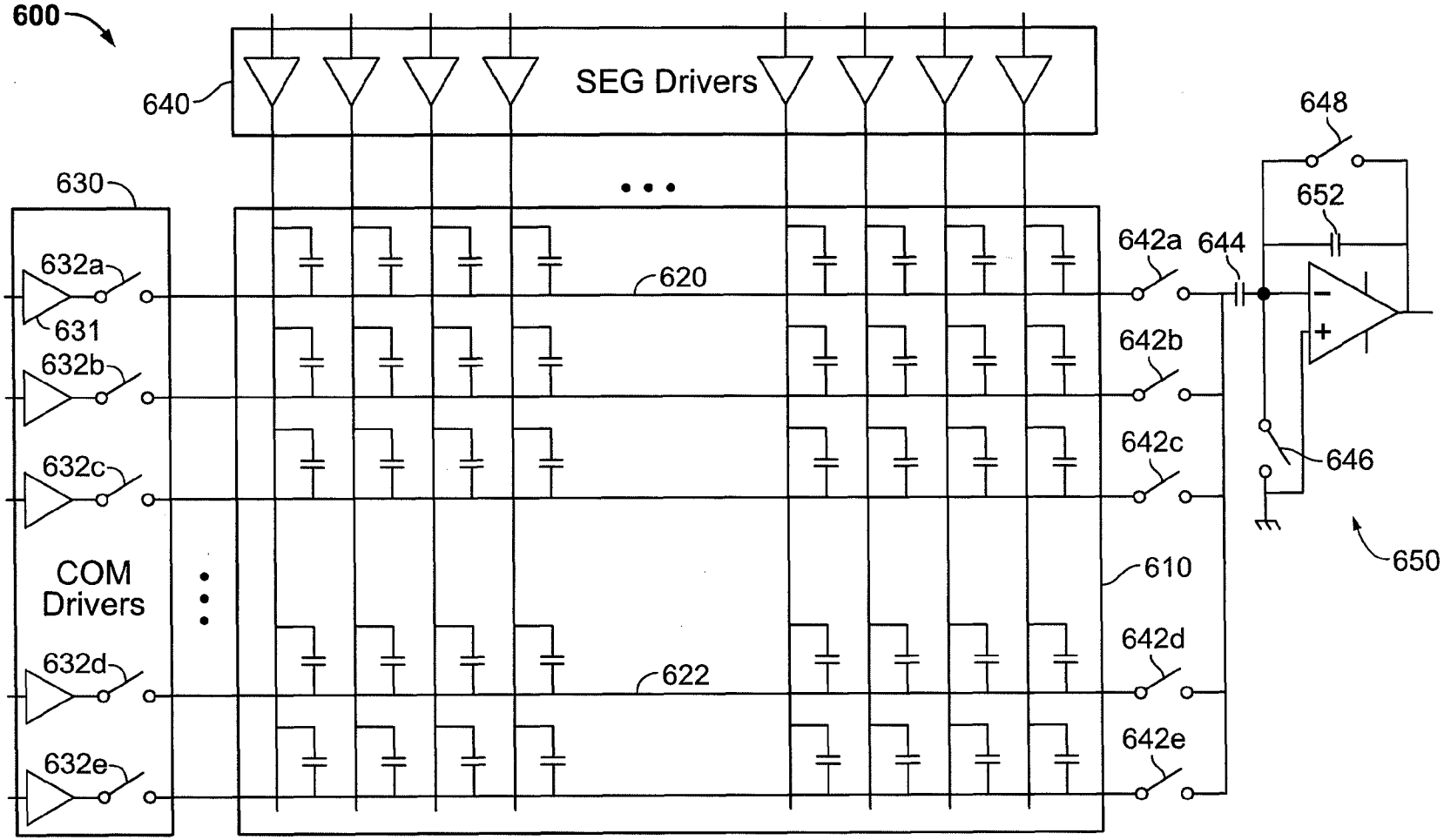
FIG. 12 is a schematic block diagram of a display array coupled to driver circuitry and state sensing circuitry.
Figure 13:
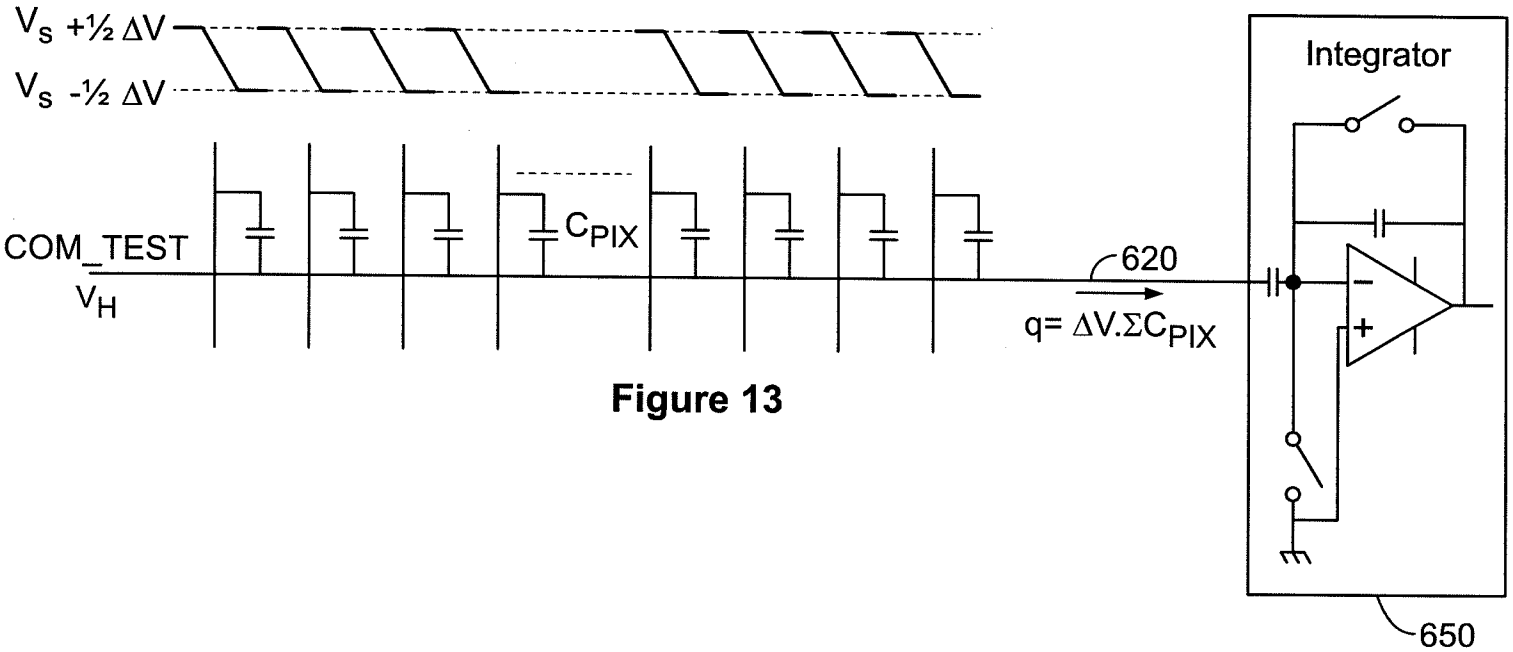
FIG. 13 is a schematic diagram showing test charge flow in the array of FIG. 12.

FIG. 12 is a schematic block diagram of a display array coupled to driver circuitry and state sensing circuitry. In this apparatus, a segment driver circuit 640 and a common diver circuit 630 are coupled to a display array 610. The display elements are illustrated as capacitors connected between respective common and segment lines. For interferometric modulators, the capacitance of the device may be about 3-10 times higher in the actuated state when the two electrodes are pulled together than it is in the released state, when the two electrodes are separated. This capacitance difference can be detected to determine the state or states of one or more display elements.

In the implementation of FIG. 12, the detection is done with an integrator 650. The function of the integrator is described with further reference to FIG. 13. FIG. 13 is a schematic diagram showing test charge flow in the array of FIG. 12. Referring now to FIG. 12 and FIG. 13, the common driver circuit 630 of FIG. 12 includes switches 632*a*-632*e* that connect test output drivers 631 to one side of one or more common lines. Another set of switches 642*a*-642*e* connect the other ends of one or more common lines to an integrator circuit 650.

As one example test protocol, each segment driver output could be set to a voltage, VS+, for example. Switches 648 and 646 of the integrator are initially closed. To test line 620, for example, switch 632*a* and switch 642*a* are closed, and a test voltage is applied to the common line 620, charging the capacitive display elements and an isolation capacitor 644. Then, switch 632*a*, 648, and 646 are opened, and the voltages output from the segment drivers are changed by an amount ΔV. The charge on the capacitors formed by the display elements is changed by an amount equal to about ΔV times the total capacitance of all the display elements. This charge flow from the display elements is converted to a voltage output by the integrator 650 with integration capacitor 652, such that the voltage output of the integrator 650 is a measure of the total capacitance of the line of display elements.

This can be used to determine the parameters $VA_{MAX_H}$, $VA_{MIN_H}$, $VR_{MAX_H}$, $VA_{MAX_L}$, $VA_{MIN_L}$, and $VR_{MAX_L}$ for a line of display elements being tested. To accomplish this, a first test voltage is applied that is known to release all of the display elements in the line. This may be 0 volts for example. In this instance, the total voltage across the display elements is VS+, which is, for example, 2V, which is within the release window of all the display elements. The output voltage of the capacitor when the segment voltages are modulated by ΔV is recorded. This integrator output may be referred to as $V_{min}$ for the line, which corresponds to the lowest line capacitance $C_{min}$ of the line. This is repeated with a common line test voltage that is known to actuate all of the display elements in the line, for example 20V. This integrator output may be referred to as $V_{max}$ for the line, which corresponds to the highest line capacitance $C_{max}$ of the line.

To determine $VA_{MAX_H}$ and $VA_{MIN_H}$ for a line, (positive polarity being defined here as common line at higher potential than segment line), the display elements of the line are first released with a low voltage, such as 0V on the common line. Then, a test voltage between 0V and 20V is applied and the output voltage of the integrator is recorded. This is repeated for a range of increasing test voltages. As the test voltages are increased from 0V to 20V, the output of the integrator 650 will be near $V_{min}$ until the modulators begin to actuate at $VA_{MIN_H}$. Thus, the test voltage which begins producing an integrator output larger than $V_{min}$ can be used to derive $VA_{MIN_H}$ as the difference between the test voltage and VS+. As the test voltage is further increased, the integrator output will then increase quickly to $V_{max}$. Thus, the test voltage which begins producing an integrator output at or near $V_{max}$ can be used to derive $VA_{MAX_H}$ as the difference between this test voltage and VS+. This process can be repeated for each line, and the smallest determined $VA_{MIN_H}$ for each line can be selected as the $VA_{MIN_H}$ for the array, and the largest determined voltage for $VA_{MAX_H}$ for each line can be selected as the $VA_{MAX_H}$ for the array. The same process can be repeated to derive a value for $VR_{MAX_H}$, except in this case the modulators in a row are first actuated by applying a high voltage such as 20V before applying a test voltage. A decreasing series of test voltages are used, and the test voltage at which the integrator output just begins to fall quickly from $V_{max}$ can be used to define $VR_{MAX_H}$. The largest determined voltage for $VR_{MAX_H}$ for each line can be selected as the $VR_{MAX_H}$ for the array. Once these three values are determined, drive scheme voltages can be computed using the formulas set forth above.

Figure 14A:
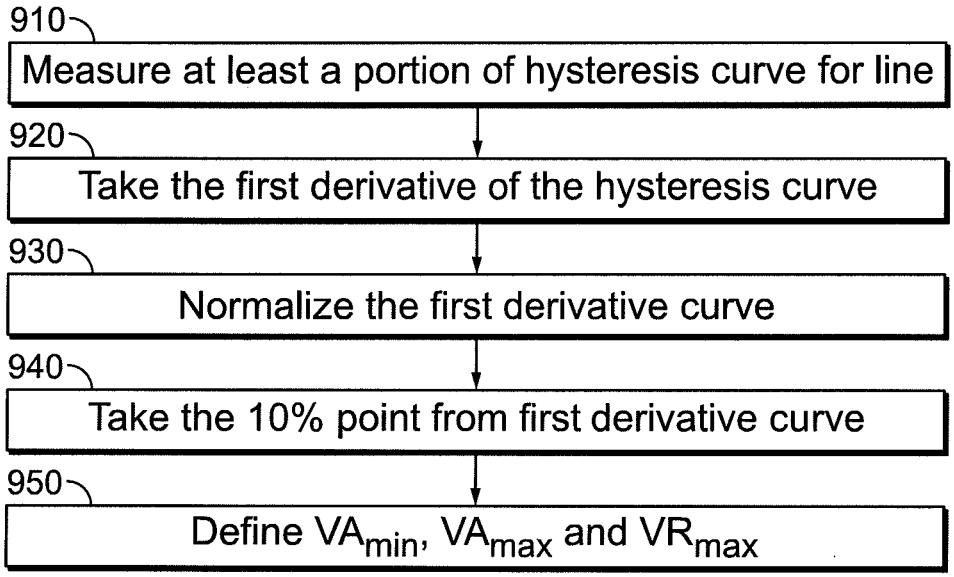
FIG. 14A is a flowchart illustrating a method of detecting display element response characteristics.
Figure 14B:
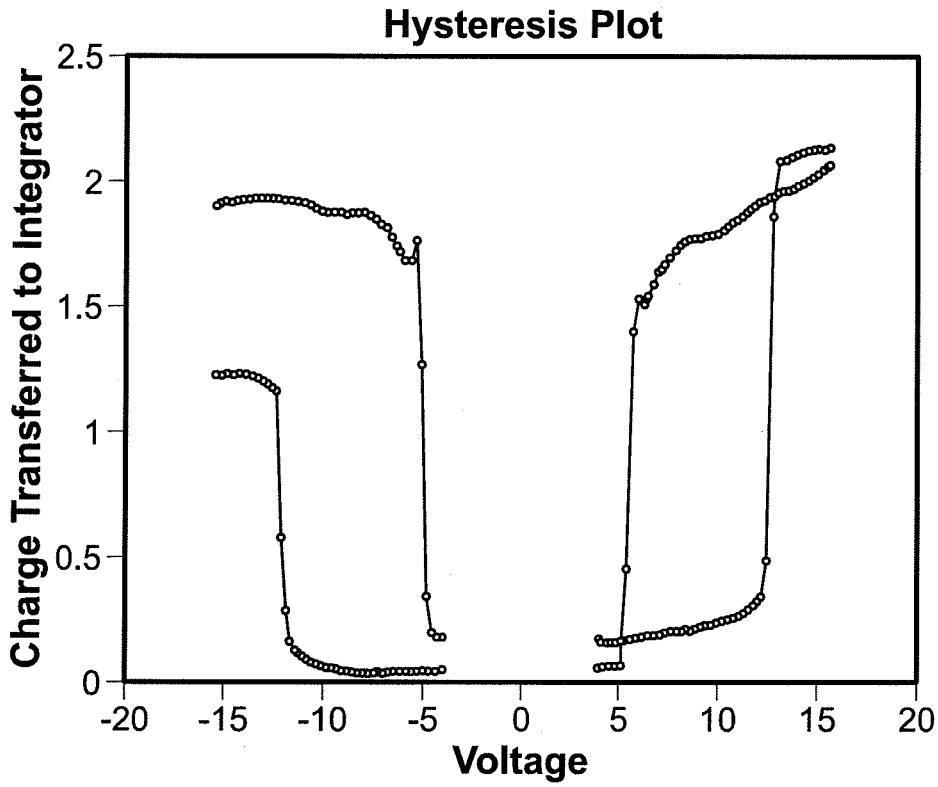
FIG. 14B is an example of data points defining a hysteresis curve for a line of display elements.
Figure 14D:
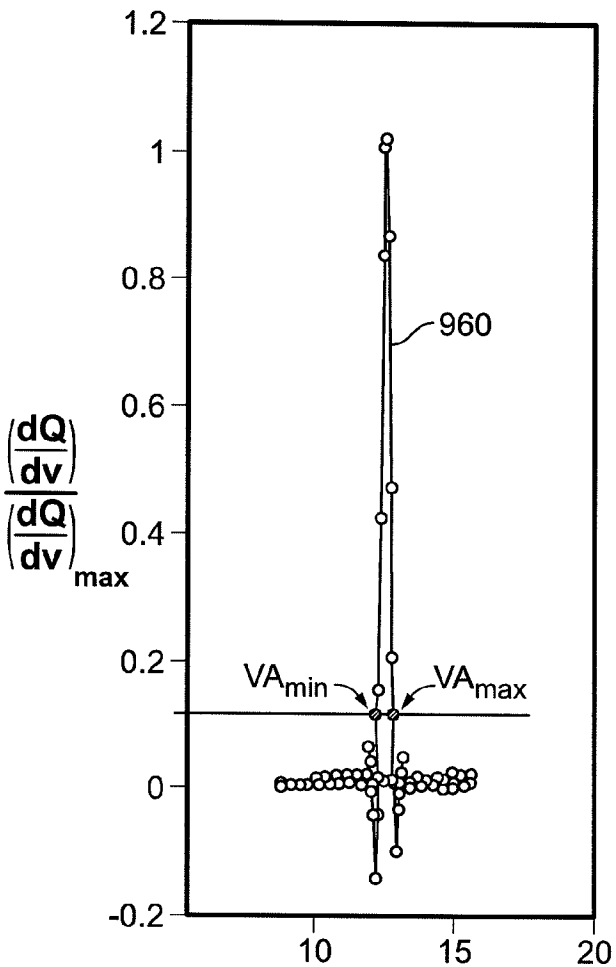
FIG. 14D is an example of selecting a $VA_{MAX_H}$ and a $VA_{MIN_H}$ from the normalized first derivative curve of FIG. 14C.
Figure 14C:
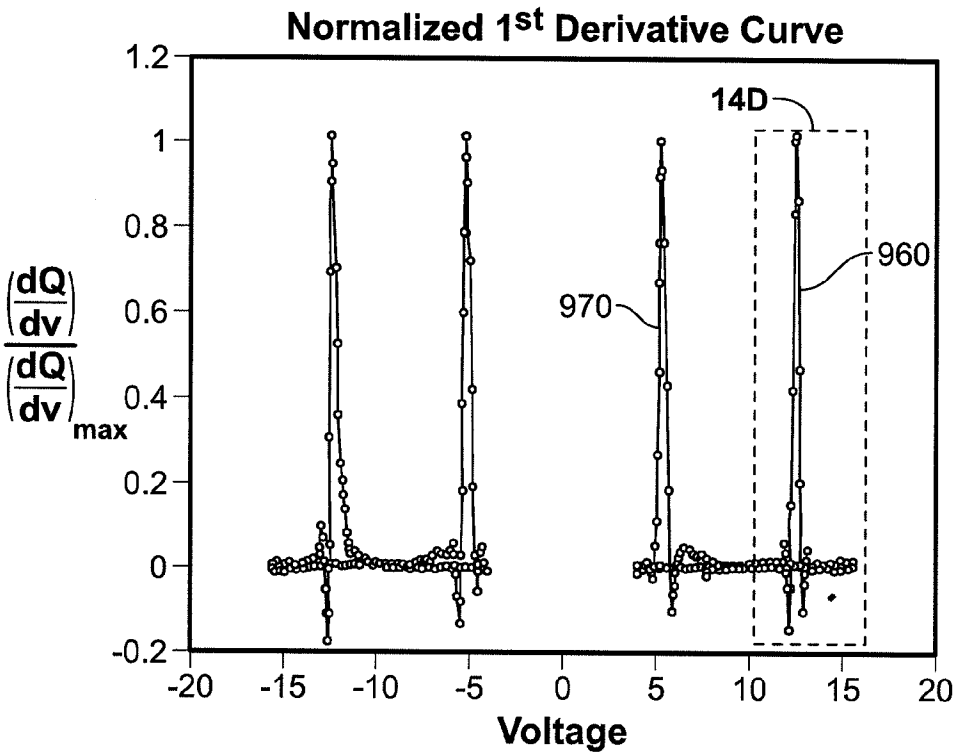
FIG. 14C is an example of an extraction of a normalized first derivative of a hysteresis curve for a line of display elements.

Another method of analyzing integrator outputs under variations of test voltages to determine the drive response parameters $VA_{MAX_H}$, $VA_{MIN_H}$, and $VR_{MAX_H}$ is set forth in FIGS. 14A through 14D. FIG. 14A is a flowchart illustrating a method of detecting display element response characteristics. FIG. 14B is an example of data points defining a hysteresis curve for a line of display elements. FIG. 14C is an example of an extraction of a normalized first derivative of a hysteresis curve for a line of display elements. FIG. 14D is an example of selecting a $VA_{MAX_H}$ and a $VA_{MIN_H}$ from the normalized first derivative curve of FIG. 14C.

As shown in FIG. 14A, a method may begin at block 910, where at least a portion of a hysteresis curve for a line of modulators is measured. This measurement may be done as described above, with increasing and decreasing series of test voltages applied to the integrator measuring circuit. FIG. 14B shows example data taken from a line of an array, where each point represents a test measurement plotted as integrator output as a function of voltage. The x-axis represents the voltage across the modulator during the test (e.g. the applied test voltage minus VS+), and the y-axis represents the amount of charge transferred to the integrator during the test, which is proportional to the capacitance of the line being measured, which in turn is a measure of how many modulators of the line are actuated. At block 920, the first derivative of the hysteresis curve (or portion thereof) is computed. These values are then normalized at block 930. The result of these computations is illustrated in FIG. 14C. The first derivative will exhibit a large peak where the slope of the hysteresis curve is steepest. The width of the rightmost peak of FIG. 14C near its bottom defines the difference between $VA_{MIN_H}$ and $VA_{MAX_H}$. To characterize this width as numerical values for $VA_{MAX_H}$ and $VA_{MIN_H}$, at block 940 the voltages at which the normalized capacitance derivative curve is equal to 10% of its maximum value are identified. At block 950, the value for $VA_{MIN_H}$ is defined as the voltage value corresponding to 10% of the peak height on the left side of the peak. The value for $VA_{MAX_H}$ is defined as the voltage value corresponding to 10% of the peak height on the right side of the peak. This is illustrated in the graph of FIG. 14D. A value for $VR_{MAX_H}$ can be derived in a similar way, using the 10% point of the right side of the peak 970 of FIG. 14C.

During manufacture of the array, this process can be performed on each line of the array to determine the parameters $VA_{MAX_H}$, $VA_{MIN_H}$ $VR_{MAX_H}$, $VA_{MAX_L}$, $VA_{MIN_L}$, and $VR_{MAX_L}$ that can be used for the array to define drive scheme voltages. For example, the hysteresis plot of FIG. 14B can be generated for each line of the array, and then, again for each line, a normalized first derivative curve can be defined. As described above and illustrated in FIG. 14D, for each line values for $VA_{MAX_H}$, $VA_{MIN_H}$, $VR_{MAX_H}$, $VA_{MAX_L}$, $VA_{MIN_L}$, and $VR_{MAX_L}$ can be generated from the normalized first derivative curves that were in turn derived from the hysteresis curves. Each line may therefore have six determined values. If there are N rows of the array tested, 6N values will be generated. From these 6N values, 6 values for the array as a whole may be selected. For example, for a monochrome array, the value of $VA_{MAX_H}$ for the array can be the maximum value found when testing each line. The value for $VA_{MIN_H}$ for the array can be the minimum value found when testing each line. The value for $VR_{MAX_H}$ for the array can be the maximum value found when testing each line. The value for $VA_{MAX_L}$ for the array can be the maximum value found when testing each line. The value for $VR_{MAX_L}$ for the array can be the maximum value found when testing each line. The value for $VA_{MIN_L}$ for the array can be the minimum value found when testing each line. For a color array, the values can be grouped by color, and drive scheme voltages for the array can also be derived as described above, where a single VS is derived for the whole array, and separate hold voltages are derived for each color and polarity.

During use of such an array, it would be possible to repeat the above described process for each line and derive new drive scheme voltages that are suitable for the current condition of the array, temperature, etc. However, this can be undesirable because this procedure can take a significant amount of time and be visible to the user. To reduce this problem, the array can be divided into subsets, and only one or more subsets of the array may be tested and characterized. These subsets can be sufficiently representative of the whole array such that the drive scheme voltages derived from these subset measurements are suitable for the whole array. This reduces the time required to perform the measurements, and can allow the process to be performed during use of the array with less inconvenience to the user. Referring back to FIG. 12, for example, a single line 622 of FIG. 12 can be selected as a representative subset of the array for testing and characterization during display use. Periodically during use of the array, switches 632*d* and 642*d* are used to test line 622 for $VA_{MAX_H}$, $VA_{MIN_H}$, $VR_{MAX_H}$, $VA_{MAX_L}$, $VA_{MIN_L}$, and $VR_{MAX_L}$ and the results are used to derive updated drive scheme voltages using formulas as set forth above. In some implementations, several lines can be used as representative subsets of the array, and tested either simultaneously or sequentially by controlling switches 632*a*-632*e* and 642*a*-642*e*, as described further below.

Figure 15:
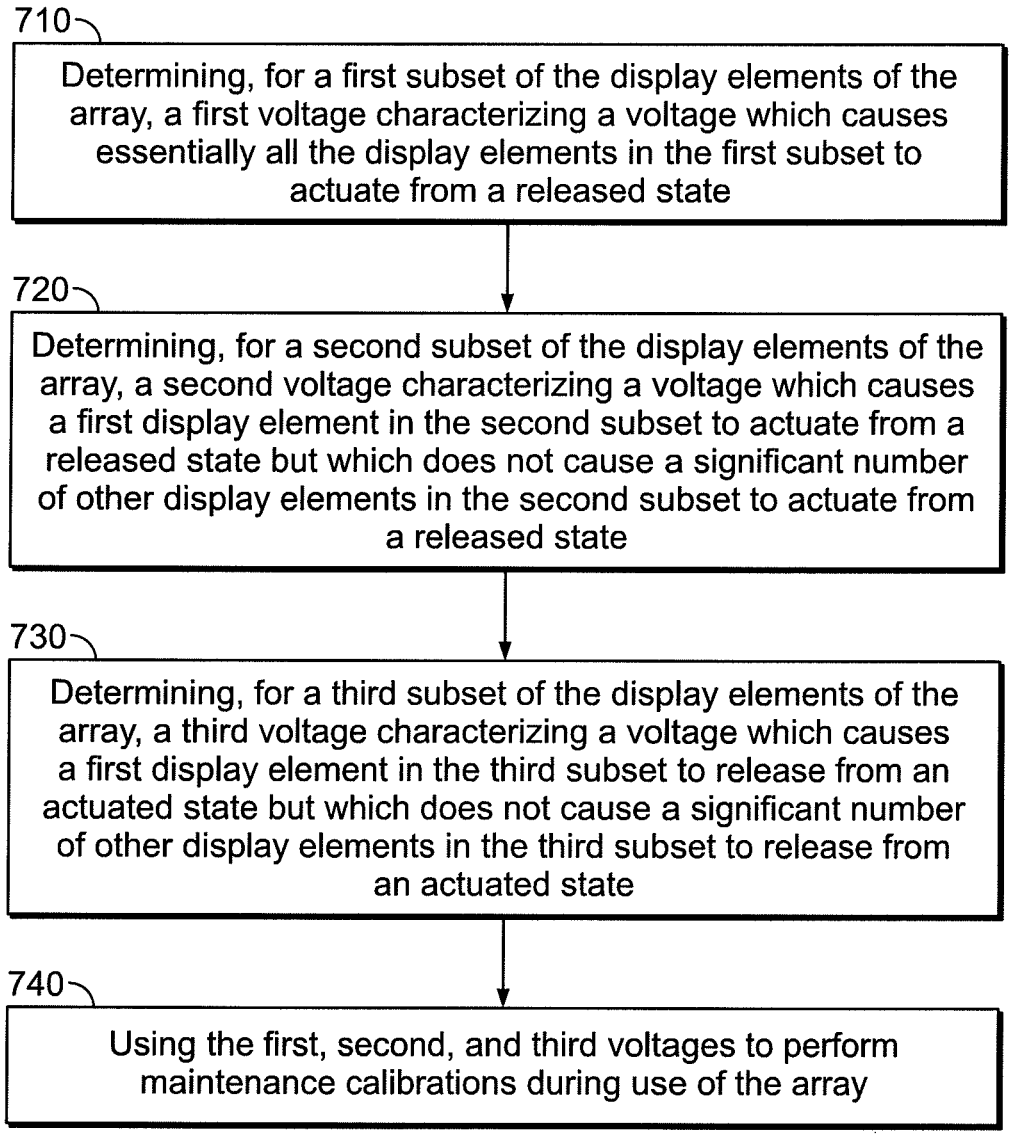
FIG. 15 is a flowchart illustrating a method of calibrating drive scheme voltages during use of an array.
Figure 16:
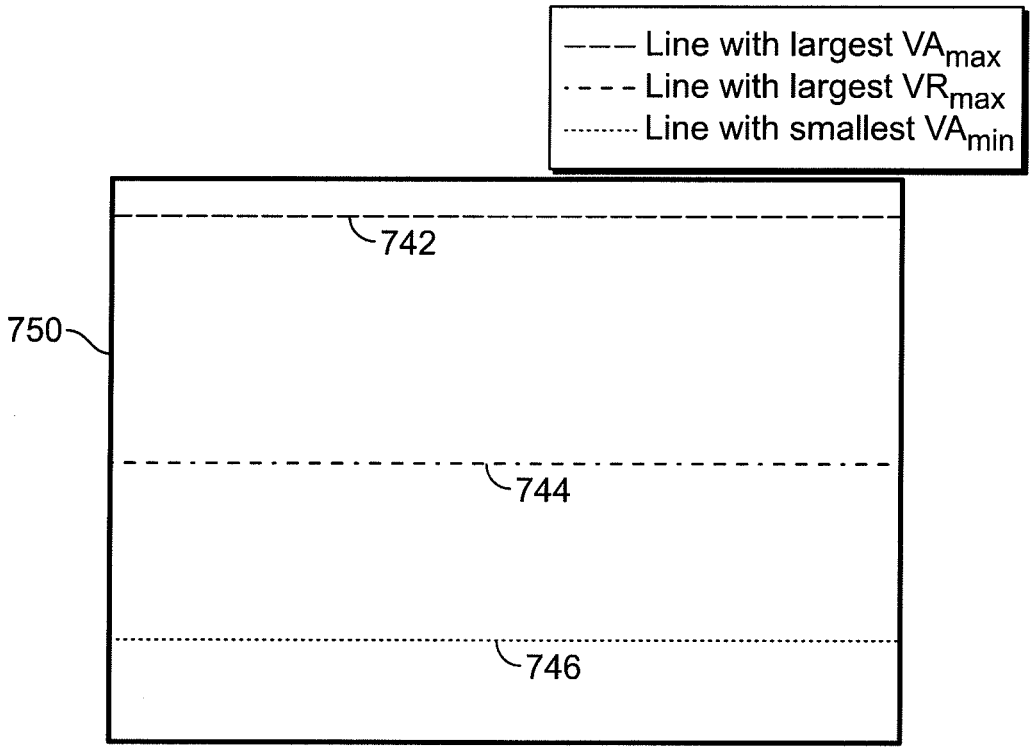
FIG. 16 illustrates an example of lines selected for state sensing during a drive scheme voltage calibration routine.

FIG. 15 is a flowchart illustrating a method of calibrating drive scheme voltages during use of an array. FIG. 16 illustrates an example of lines selected for state sensing during a drive scheme voltage calibration routine. In FIG. 16, an entire display array 750 is illustrated having a series of horizontally arranged common lines, including lines 742, 744, and 746 which are described in further detail below. Referring now to these two figures, a method of updating drive scheme voltages during use of an array will be described. As noted above, Equations 1-4 for deriving a set of drive scheme voltages utilize as inputs the values $VA_{MAX_H}$, $VA_{MIN_H}$, $VR_{MAX_H}$ for a monochrome array with a zero offset voltage. To perform calibration updates of drive scheme voltages during use of an array, the drive response characteristics of subsets of the array may be characterized to determine values for $VA_{MAX_H}$, $VA_{MIN_H}$, and $VR_{MAX_H}$ for the different subsets. The particular subsets having extremes for these values can be utilized to derive drive scheme voltages for the whole array. This has the advantage that there is no need to test the whole array during use, thus reducing the impact the testing scheme has on the user experience.

In one implementation, the lines of the array may first be characterized by the testing described above. From this initial testing, which may be performed during or soon after display manufacture, the lines with the largest $VA_{MAX_H}$, the smallest $VA_{MIN_H}$, and the largest $VR_{MAX_H}$ may be identified. This is illustrated in FIG. 16 by lines 742, 746, and 744 respectively. Returning to FIG. 15, a method of calibrating drive scheme voltages in an array begins at block 710. At this block, the method determines, for a first subset of the display elements of the array, a first voltage characterizing a voltage which causes essentially all the display elements in the first subset to actuate from a released state. In one implementation, this may involve measuring a value for $VA_{MAX_H}$ using the line of the array previously identified as having the highest value for $VA_{MAX_H}$. At block 720, the method determines, for a second subset of the display elements of the array, a second voltage characterizing a voltage which causes a first display element in the second subset to actuate from a released state but which does not cause a significant number of other display elements in the second subset to actuate from a released state. In one implementation, this may involve measuring a value for $VA_{MIN_H}$ using the line of the array previously identified as having the lowest value for $VA_{MIN_H}$. At block 730, the method determines, for a third subset of the display elements of the array, a third voltage characterizing a voltage which causes a first display element in the third subset to release from an actuated state but which does not cause a significant number of other display elements in the third subset to release from an actuated state. In one implementation, this may involve measuring a value for $VR_{MAX_H}$ using the line of the array previously identified as having the highest value for $VR_{MAX_H}$. At block 740, the first, second, and third voltages are used to perform maintenance calibrations during use of the array. The maintenance calibrations may involve using the values for $VA_{MAX_H}$, $VA_{MIN_H}$, and $VR_{MAX_H}$ measured for the subsets to compute drive scheme voltages using the formulas above. The drive scheme voltages used during operation of the display can then be modified periodically over the lifetime of the display.

The example illustrated by FIGS. 15 and 16 is for a monochrome array with an assumed zero offset voltage. For non-zero offset voltages, an additional measurement of $VA_{MAX_L}$, $VA_{MIN_L}$, and $VR_{MAX_L}$ for the other polarity hysteresis can be made. In this case, three additional lines will be measured: (1) the line having the lowest $VA_{MIN_L}$, of the whole array, (2) the line having the largest $VA_{MAX_L}$ of the whole array, and (3) the line having the highest $VR_{MAX_L}$ of the whole array would be determined, and these lines would be used for subsequent measurements as described above for the other drive response characteristics. For a color array with non-zero offset voltage, each set of lines of each color may be treated separately. In this case, six lines may be initially selected having highest $VA_{MAX_H}$, lowest $VA_{MIN_H}$, highest $VR_{MAX_H}$, lowest $VA_{MIN_L}$, highest $VA_{MAX_L}$, lowest $VA_{MIN_L}$ and highest $VR_{MAX_L}$ for each color, a total of eighteen measured lines. A value for $V_S$ may be determined by taking the largest value for the right side of Equation 1 for both polarity hysteresis windows for all the colors, and the smallest value for the right side of Equation 2 for both polarity hysteresis windows for all the colors. The average of these two may be the value used for $V_S$. A positive and negative hold voltage for each color can be determined using Equation 4 and the values for $VA_{MIN_H}$ and $VA_{MIN_L}$, for each color. For a three color display, 12 measurements of 12 lines will produce data allowing the computation of one segment voltage $V_S$ for the whole array and six hold voltages $V_H$ for the positive and negative polarity hold voltage for each of the three colors.

Figure 17:
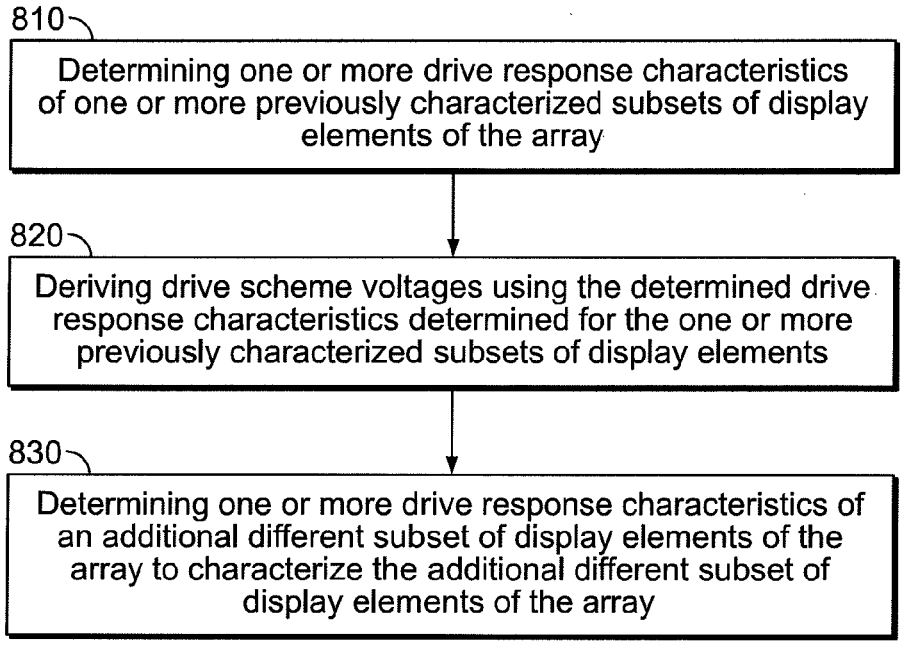
FIG. 17 is a flowchart illustrating a method of calibrating drive scheme voltages during use of an array.
Figure 18:
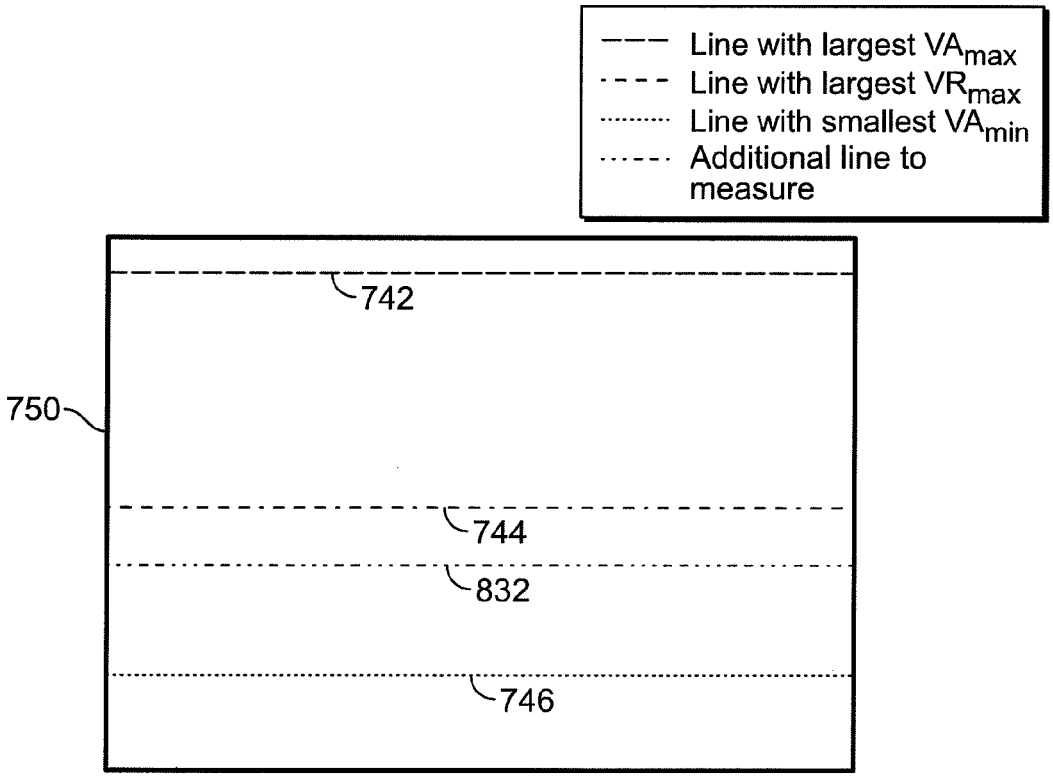
FIG. 18 illustrates an example of lines selected for state sensing during a drive scheme voltage calibration routine.

As noted above, the drive response characteristics of the display elements of an array may change over time and with temperature. This can affect the maintenance calibration scheme set forth with respect to FIGS. 15 and 16 because it may be that the selected subsets initially chosen for maintenance measurements may no longer be the subsets having the desired extreme values for $VA_{MAX_H}$, $VA_{MIN_H}$, and $VR_{MAX_H}$. This issue can be alleviated using the scheme described with respect to FIGS. 17 and 18. FIG. 17 is a flowchart illustrating a method of calibrating drive scheme voltages during use of an array. FIG. 18 illustrates an example of lines selected for state sensing during a drive scheme voltage calibration routine. As with FIG. 16, FIG. 18 illustrates an entire display array 750 having a series of horizontally arranged common lines, including the lines 742, 744, and 746 as well as additional line 832. Generally, the method of FIG. 17 periodically characterizes the drive response characteristics of a new subset of the array. If the new subset has a more extreme value for $VA_{MAX_H}$, $VA_{MIN_H}$, or $VR_{MAX_H}$ (or also possibly $VA_{MAX_L}$, $VA_{MIN_L}$, and $VR_{MAX_L}$) than the subset currently being used for that parameter, the new subset is substituted for the original subset for future measurements of that parameter.

Referring now to FIG. 17, the method may begin at block 810 where the method determines one or more drive response characteristics of one or more previously characterized subsets of display elements of the array. At block 820 the method derives drive scheme voltages using the drive response characteristics determined for the one or more previously characterized subsets of display elements. One implementation of a method to derive drive scheme voltages using the determined drive response characteristics has been discussed in details above with reference to FIG. 15. The drive response characteristics may be $VA_{MAX_H}$, $VA_{MIN_H}$, or $VR_{MAX_H}$, and the previously characterized subsets may be the lines previously determined with the largest $VA_{MAX_H}$, smallest $VA_{MIN_H}$, and largest $VR_{MAX_H}$. These lines are illustrated in FIG. 18 as in FIG. 16 as lines 742, 746, and 744 respectively. At block 830, the method determines one or more drive response characteristics of an additional different subset of display elements of the array to characterize the additional different subset of display elements of the array. An example of this is shown as line 832 in FIG. 18. When the additional subset is measured (e.g., line 832 in FIG. 18), one or more of the parameters $VA_{MAX_H}$, $VA_{MIN_H}$, and/or $VR_{MAX_H}$ (and/or also possibly $VA_{MAX_L}$, $VA_{MIN_L}$ and $VR_{MAX_L}$) are measured for that subset. If that subset has, for example, a larger $VA_{MAX_H}$ than the subset currently being used to measure $VA_{MAX_H}$, then the new subset (e.g., line 832 in FIG. 18) is used in future measurements of that parameter rather than the original subset (e.g., line 742 in FIG. 18). In this way, changes over temperature, time, and the like in the array that result in changes to which subsets exhibit the extremes of drive response characteristics are accounted for.

In operation, the additional subset to measure can be chosen randomly, pseudorandomly, or according to any predefined selection pattern. For a three color RGB array with a non-zero offset voltage, the initial set of selected lines could include eighteen (18) different lines, with one line of each of the red, green, and blue lines being used to define $VA_{MAX_H}$, $VA_{MIN_H}$, $VR_{MAX_H}$, $VA_{MAX_L}$, $VA_{MIN_L}$, and $VR_{MAX_L}$ for each color. Periodically, a $19^{th}$ line could be selected, and used to test one parameter of one color. For example, a blue line could be selected that is different from the current set of 18 and used to determine $VR_{MAX_H}$ for blue. If the $VR_{MAX_H}$ for this newly selected line is smaller than the $VR_{MAX_H}$ of the one of the 18 lines currently being used to determine $VR_{MAX_H}$ for blue, nothing is changed. However, if the $VR_{MAX_H}$ of the newly selected blue line is greater than the $VR_{MAX_H}$ of the currently used blue line, the newly selected line is used in the future for measurements of $VR_{MAX_H}$ for blue when updated drive scheme voltages are computed. This is periodically repeated for additional newly selected lines, for example a green line that is different from the current set of 18 may be then selected to determine $VA_{MAX_H}$ for green. If the newly selected line has a higher $VA_{MAX_H}$ than the existing extreme value of $VA_{MAX_H}$ for green, the new line is substituted for future use when performing maintenance calibrations that compute updated drive scheme voltages.

Figure 19A:
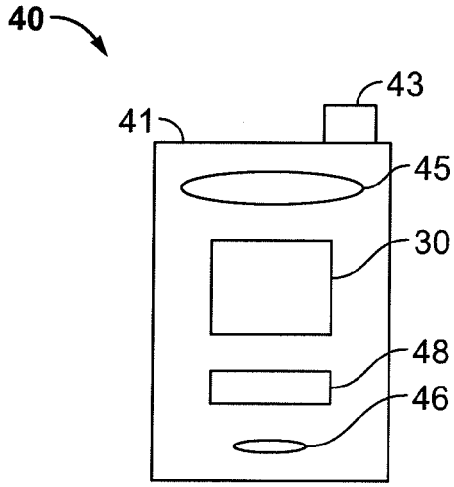
FIGS. 19A and 19B show examples of system block diagrams illustrating a display device that includes a plurality of interferometric modulators.
Figure 19B:
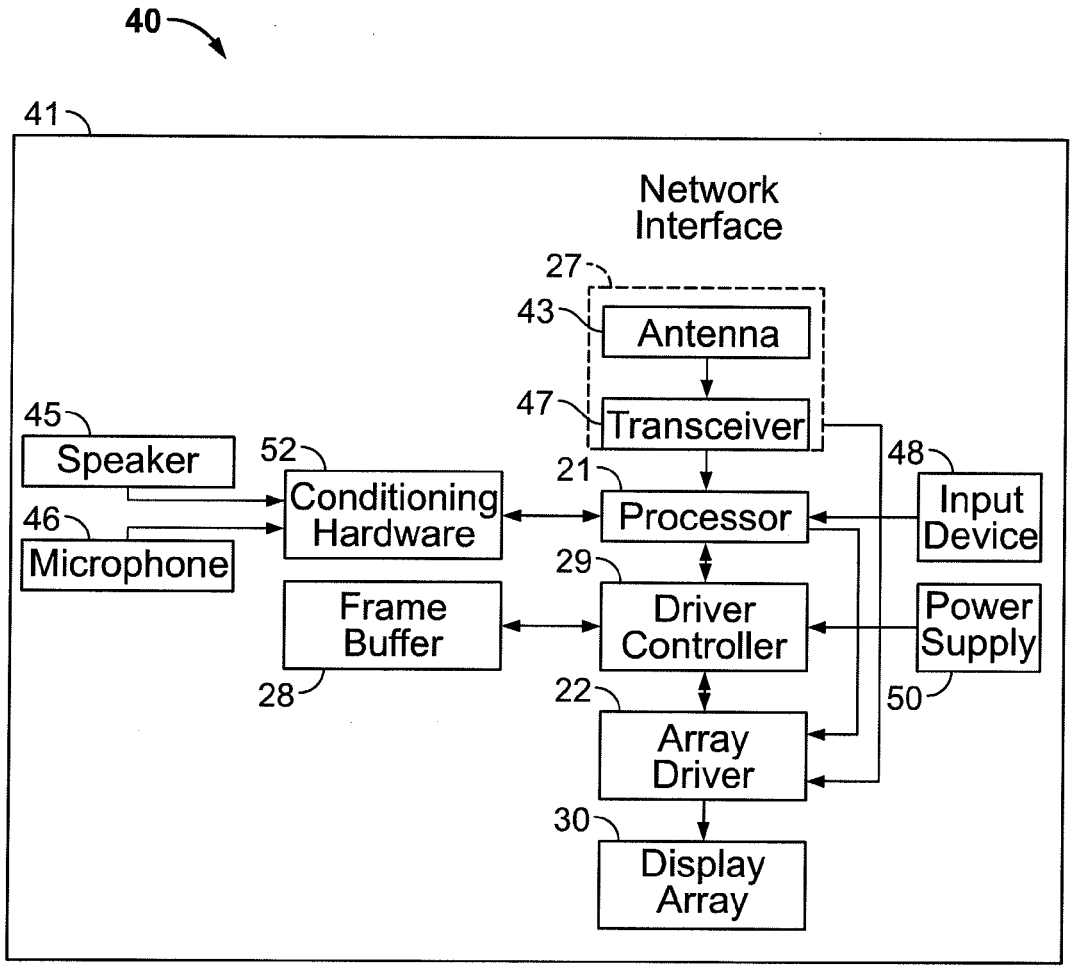

FIGS. 19A and 19B show examples of system block diagrams illustrating a display device 40 that includes a plurality of interferometric modulators. The display device 40 can be, for example, a cellular or mobile telephone. However, the same components of the display device 40 or slight variations thereof are also illustrative of various types of display devices such as televisions, e-readers and portable media players.

The display device 40 includes a housing 41, a display 30, an antenna 43, a speaker 45, an input device 48, and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber, and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, EL, OLED, STN LCD, or TFT LCD, or a non-flat-panel display, such as a CRT or other tube device. In addition, the display 30 can include an interferometric modulator display, as described herein.

The components of the display device 40 are schematically illustrated in FIG. 17B. The display device 40 includes a housing 41 and can include additional components at least partially enclosed therein. For example, the display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g., filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 can provide power to all components as required by the particular display device 40 design.

The network interface 27 includes the antenna 43 and the transceiver 47 so that the display device 40 can communicate with one or more devices over a network. The network interface 27 also may have some processing capabilities to relieve, e.g., data processing requirements of the processor 21. The antenna 43 can transmit and receive signals. In some implementations, the antenna 43 transmits and receives RF signals according to the IEEE 16.11 standard, including IEEE 16.11 (a), (b), or (g), or the IEEE 802.11 standard, including IEEE 802.11a, b, g or n. In some other implementations, the antenna 43 transmits and receives RF signals according to the BLUETOOTH standard. In the case of a cellular telephone, the antenna 43 is designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G or 4G technology. The transceiver 47 can pre-process the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that is readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation, and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a stand-alone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements.

In some implementations, the driver controller 29, the array driver 22, and the display array 30 are appropriate for any of the types of displays described herein. For example, the driver controller 29 can be a conventional display controller or a bi-stable display controller (e.g., an IMOD controller). Additionally, the array driver 22 can be a conventional driver or a bi-stable display driver (e.g., an IMOD display driver). Moreover, the display array 30 can be a conventional display array or a bi-stable display array (e.g., a display including an array of IMODs). In some implementations, the driver controller 29 can be integrated with the array driver 22. Such an implementation is common in highly integrated systems such as cellular phones, watches and other small-area displays.

In some implementations, the input device 48 can be configured to allow, e.g., a user to control the operation of the display device 40. The input device 48 can include a keypad, such as a QWERTY keyboard or a telephone keypad, a button, a switch, a rocker, a touch-sensitive screen, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices as are well known in the art. For example, the power supply 50 can be a rechargeable battery, such as a nickel-cadmium battery or a lithium-ion battery. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

The various illustrative logics, logical blocks, modules, circuits and algorithm steps described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and steps described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. In some implementations, particular steps and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The steps of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. The word "exemplary" is used exclusively herein to mean "serving as an example, instance, or illustration." Any implementation described herein as "exemplary" is not necessarily to be construed as preferred or advantageous over other implementations. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the IMOD as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. A method of calibrating drive scheme voltages in an array including a plurality of display elements, the method comprising:

determining, for a first subset of the display elements of the array, a first voltage characterizing a voltage which causes essentially all the display elements in the first subset to actuate from a released state;

determining, for a second subset of the display elements of the array, a second voltage characterizing a voltage which causes a first display element in the second subset to actuate from a released state but which does not cause a significant number of other display elements in the second subset to actuate from a released state;

determining, for a third subset of the display elements of the array, a third voltage characterizing a voltage which causes a first display element in the third subset to release from an actuated state but which does not cause a significant number of other display elements in the third subset to release from an actuated state; and using the first, second, and third voltages to perform maintenance calibrations during use of the array over at least some portion of the life of the array.

2. The method of claim 1, further comprising determining at least one of the first, second, and third voltages for a fourth subset of display elements of the array, wherein the fourth subset is randomly or pseudorandomly selected.

3. The method of claim 2, further comprising substituting the fourth subset of display elements of the array for one of the first, second or third subsets of display elements of the array.

4. The method of claim 3, further comprising calibrating the drive scheme voltages using voltages determined for one or more of the first, second, or third subsets of display elements and the voltage determined for the fourth subset of display elements of the array.

5. The method of claim 1, further comprising determining at least one drive scheme voltage based at least in part on the first voltage, second voltage, and third voltage.

6. The method of claim 5, wherein the at least one drive scheme voltage includes one or both of a hold voltage and a segment voltage.

7. The method of claim 6, further comprising driving an array to display an image using the determined drive scheme voltages.

8. The method of claim 5, wherein using the first, second, and third voltages to perform maintenance calibrations includes repeatedly determining first, second, and third voltages, and updating drive scheme voltages based on the determined first, second, and third voltages at periodic intervals over the lifetime of the display.

9. The method of claim 1, wherein determining includes determining a hysteresis curve for a subset of display elements.

10. The method of claim 9, wherein determining includes computing a first derivative of a hysteresis curve for a subset of display elements.

11. A method of calibrating drive scheme voltages in an array including a plurality of display elements, the method comprising:

determining one or more drive response characteristics of one or more previously characterized subsets of display elements of the array;

deriving drive scheme voltages using the determined drive response characteristics determined for the one or more previously characterized subsets of display elements;

determining one or more drive response characteristics of an additional different subset of display elements of the array to characterize the additional different subset of display elements of the array; and substituting the additional different subset of display elements of the array for one of the one or more previously characterized subsets of display elements of the array.

12. The method of claim 11, further comprising updating the drive scheme voltages using the drive response characteristics determined for one or more previously characterized subsets of display elements and the drive response characteristic of the additional different subset of display elements of the array.

13. The method of claim 12, wherein the drive response characteristics include one or more of a first voltage characterizing a voltage which causes essentially all the display elements in a first subset to actuate from a released state, a second voltage characterizing a voltage which causes a first display element in a second subset to actuate from a released state but which does not cause a significant number of other display elements in the subset to actuate from a released state, and a third voltage characterizing a voltage which causes a first display element in a third subset to release from an actuated state but which does not cause a significant number of other display elements in the subset to release from an actuated state.

14. The method of claim 13, wherein deriving includes substituting the determined drive response characteristics into formulas for drive scheme voltage values.

15. The method of claim 14, wherein at least some drive scheme voltage values are derived from the formulas:

$$VS=(VA\mathrm{MAX}_H-VR\mathrm{MAX}_H+OV-AL)/4$$

$$VH=VA\mathrm{MIN}_H-SO-VS$$

wherein VS is a derived segment voltage, VH is a derived hold voltage, VAMAX_H is the first voltage characterizing a voltage which causes essentially all the display elements in the first subset to actuate from a released state, VRMAX_H is the second voltage characterizing a voltage which causes a first display element in a second subset to actuate from a released state but which does not cause a significant number of other display elements in the subset to actuate from a released state, VAMIN_H is the third voltage characterizing a voltage which causes a first display element in a third subset to release from an actuated state but which does not cause a significant number of other display elements in the subset to release from an actuated state, OV is an empirically determined value representing a voltage amount above VAMAX_H that is to be provided to the display elements during actuation, AL is an empirically determined value representing a voltage amount above VRMAX_H that is to be provided to the display elements during hold states; and SO is an empirically determined value representing a voltage below above VAMIN_H that is to be provided to the display elements during hold states.

16. The method of claim 11, further comprising randomly or pseudorandomly selecting the additional different subset of display elements.

17. An apparatus for calibrating drive scheme voltages, the apparatus comprising:

an array of display elements;

display element state sensing circuitry; and driver and processor circuitry configured to:

determine, for a first subset of the display elements of the array, a first voltage characterizing a voltage which causes essentially all the display elements in the first subset to actuate from a released state;

determine, for a second subset of the display elements of the array, a second voltage characterizing a voltage which causes a first display element in the second subset to actuate from a released state but which does not cause a significant number of other display elements in the second subset to actuate from a released state;

determine, for a third subset of the display elements of the array, a third voltage characterizing a voltage which causes a first display element in the third subset to release from an actuated state but which does not cause a significant number of other display elements in the third subset to release from an actuated state; and use the first, second, and third voltages to perform maintenance calibrations during use of the array.

18. The apparatus of claim 17, wherein the driver and processor circuitry is further configured to determine at least one of the first, second, and third voltages for a fourth subset of display elements of the array, wherein the fourth subset is randomly or pseudorandomly selected.

19. The apparatus of claim 18, wherein the driver and processor circuitry is further configured to substitute the fourth subset of display elements of the array for one of the first, second or third subsets of display elements of the array.

20. The apparatus of claim 19, wherein the driver and processor circuitry is further configured to calibrate the drive scheme voltages using voltages determined for one or more of the first, second, or third subsets of display elements and the voltage determined for the fourth subset of display elements of the array.

21. The apparatus of claim 17, wherein the driver and processor circuitry is further configured to determine at least one drive scheme voltage based at least in part on the first voltage, second voltage, and third voltage.

22. The apparatus of claim 21, wherein the at least one drive scheme voltage includes one or both of a hold voltage and a segment voltage.

23. The apparatus of claim 22, wherein the driver and processor circuitry is further configured to drive an array to display an image using the determined drive scheme voltages.

24. The apparatus of claim 21, wherein the driver and processor circuitry is configured to use the first, second, and third voltages to perform maintenance calibrations by repeatedly determining first, second, and third voltages, and updating drive scheme voltages based on the determined first, second, and third voltages at periodic intervals over the lifetime of the display.

25. The apparatus of claim 17, further comprising:

a display;

a processor that is configured to communicate with the display, the processor being configured to process image data; and a memory device that is configured to communicate with the processor.

26. The apparatus as recited in claim 25, further comprising:

a driver circuit configured to send at least one signal to the display; and a controller configured to send at least a portion of the image data to the driver circuit.

27. The apparatus as recited in claim 25, further comprising:

an image source module configured to send the image data to the processor.

28. The apparatus as recited in claim 27, wherein the image source module includes at least one of a receiver, transceiver, and transmitter.

29. The apparatus as recited in claim 25, further comprising:

an input device configured to receive input data and to communicate the input data to the processor.

30. An apparatus for calibrating drive scheme voltages, the apparatus comprising:

an array of display elements;

display element state sensing circuitry; and driver and processor circuitry capable of:

determining one or more drive response characteristics of one or more previously characterized subsets of display elements of the array;

deriving drive scheme voltages using the determined drive response characteristics determined for the one or more previously characterized subsets of display elements; and determining one or more drive response characteristics of an additional different subset of display elements of the array to characterize the additional different subset of display elements of the array, and substituting the additional different subset of display elements of the array for one of the one or more previously characterized subsets of display elements of the array.

31. The apparatus of claim 30, wherein the driver and processor circuitry is further capable of updating the drive scheme voltages using the drive response characteristics determined for one or more previously characterized subsets of display elements and the drive response characteristic of the additional different subset of display elements of the array.

32. The apparatus of claim 31, wherein the drive response characteristics include one or more of a first voltage characterizing a voltage which causes essentially all the display elements in a first subset to actuate from a released state, a second voltage characterizing a voltage which causes a first display element in a second subset to actuate from a released state but which does not cause a significant number of other display elements in the subset to actuate from a released state, and a third voltage characterizing a voltage which causes a first display element in a third subset to release from an actuated state but which does not cause a significant number of other display elements in the subset to release from an actuated state.

33. The apparatus of claim 32, wherein deriving comprises substituting the determined drive response characteristics into formulas for drive scheme voltage values.

34. The apparatus of claim 33, wherein at least some drive scheme voltage values are derived from the formulas:

$$VS=(VA\mathrm{MAX}_H-VR\mathrm{MAX}_H+OV-AL)/4$$

$$VH=VA\mathrm{MIN}_H-SO-VS$$

wherein VS is a derived segment voltage, VH is a derived hold voltage, VAMAX_H is the first voltage characterizing a voltage which causes essentially all the display elements in the first subset to actuate from a released state, VRMAX_H is the second voltage characterizing a voltage which causes a first display element in a second subset to actuate from a released state but which does not cause a significant number of other display elements in the subset to actuate from a released state, VAMIN_H is the third voltage characterizing a voltage which causes a first display element in a third subset to release from an actuated state but which does not cause a significant number of other display elements in the subset to release from an actuated state, OV is an empirically determined value representing a voltage amount above VAMAX_H that is to be provided to the display elements during actuation, AL is an empirically determined value representing a voltage amount above VRMAX_H that is to be provided to the display elements during hold states; and SO is an empirically determined value representing a voltage below above VAMIN_H that is to be provided to the display elements during hold states.

35. The apparatus of claim 30, wherein the driver and processor circuitry is further-capable of selecting randomly or pseudorandomly the additional different subset of display elements.

36. A non-transitory tangible computer readable media having stored thereon instructions causing a driver circuit to perform a method of:

determining, for a first subset of the display elements of the array, a first voltage characterizing a voltage which causes essentially all the display elements in the first subset to actuate from a released state;

determining, for a second subset of the display elements of the array, a second voltage characterizing a voltage which causes a first display element in the second subset to actuate from a released state but which does not cause a significant number of other display elements in the second subset to actuate from a released state;

determining, for a third subset of the display elements of the array, a third voltage characterizing a voltage which causes a first display element in the third subset to release from an actuated state but which does not cause a significant number of other display elements in the third subset to release from an actuated state; and using the first, second, and third voltages to perform maintenance calibrations during use of the array.

37. The computer readable media of claim 36, wherein the instructions cause the driver circuit to determine at least one drive scheme voltage based at least in part on the first voltage, second voltage, and third voltage.

38. The computer readable media of claim 37, wherein the at least one drive scheme voltage is one or both of a hold voltage and a segment voltage.

39. The computer readable media of claim 38, wherein the instructions cause the driver circuit to drive an array to display an image using the determined drive scheme voltages.

40. The computer readable media of claim 38, wherein the instructions cause the driver circuit to use the first, second, and third voltages to perform maintenance calibrations by repeatedly determining first, second, and third voltages, and updating drive scheme voltages based on the determined first, second, and third voltages at periodic intervals over the lifetime of the display.

41. A non-transitory tangible computer readable media having stored thereon instructions causing a driver circuit to perform a method of:

determining one or more drive response characteristics of one or more previously characterized subsets of display elements of the array;

deriving drive scheme voltages using the determined drive response characteristics determined for the one or more previously characterized subsets of display elements;

determining one or more drive response characteristics of an additional different subset of display elements of the array to characterize the additional different subset of display elements of the array, and substituting the additional different subset of display elements of the array for one of the one or more previously characterized subsets of display elements of the array.

42. The computer readable media of claim 41, wherein the instructions cause the driver circuit to update the drive scheme voltages using the drive response characteristics determined for one or more previously characterized subsets of display elements and the drive response characteristic of the additional different subset of display elements of the array.

* * * * *